US011043155B2

(12) United States Patent
Kim et al.

(10) Patent No.: US 11,043,155 B2
(45) Date of Patent: Jun. 22, 2021

(54) DATA PROCESSING DEVICE, DATA DRIVING DEVICE AND SYSTEM FOR DRIVING DISPLAY DEVICE

(71) Applicant: SILICON WORKS CO., LTD., Daejeon (KR)

(72) Inventors: Do Seok Kim, Daejeon (KR); Yong Hwan Mun, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/749,565

(22) Filed: Jan. 22, 2020

(65) Prior Publication Data

US 2020/0251036 A1 Aug. 6, 2020

(30) Foreign Application Priority Data

Jan. 31, 2019 (KR) ..... 10-2019-0012322

(51) Int. Cl.
*G09G 3/20* (2006.01)

(52) U.S. Cl.
CPC ..... *G09G 3/20* (2013.01); *G09G 2310/027* (2013.01); *G09G 2310/08* (2013.01)

(58) Field of Classification Search
CPC . G09G 3/20; G09G 2310/027; G09G 2310/08
See application file for complete search history.

(56) References Cited

U.S. PATENT DOCUMENTS

| | | | | |
|---|---|---|---|---|
| 8,149,253 | B2 | 4/2012 | Lee | |
| 10,504,412 | B2 | 12/2019 | Han et al. | |
| 2010/0225620 | A1 | 9/2010 | Lee | |
| 2014/0078133 | A1 | 3/2014 | Lee et al. | |
| 2018/0114479 | A1 | 4/2018 | Han et al. | |
| 2019/0279585 | A1* | 9/2019 | Suzuki | G09G 3/20 |
| 2019/0279600 | A1* | 9/2019 | Chan | G06F 3/0412 |

FOREIGN PATENT DOCUMENTS

| | | | |
|---|---|---|---|
| JP | 5179467 | B2 | 1/2013 |
| JP | 2018-072829 | A | 5/2018 |

* cited by examiner

*Primary Examiner* — Sejoon Ahn
(74) *Attorney, Agent, or Firm* — Fenwick & West LLP

(57) ABSTRACT

An embodiment provides a technology for performing both high-speed data communication and low-speed data communication and transmitting a configuration value for the high-speed data communication through the low-speed data communication.

20 Claims, 26 Drawing Sheets

DATA PROCESSING DEVICE, DATA DRIVING DEVICE AND SYSTEM FOR DRIVING DISPLAY DEVICE

CROSS REFERENCE TO RELATED APPLICATION

This application claims priority from Republic of Korea Patent Application No. 10-2019-0012322, filed on Jan. 31, 2019, which is hereby incorporated by reference in its entirety.

BACKGROUND

1. Field of the Invention

The present disclosure relates to a technique for driving a display device.

2. Description of the Prior Art

A display panel is composed of a plurality of pixels arranged in a matrix form, and each pixel is composed of subpixels such as red (R), green (G), and blue (B). Each of the subpixels displays an image on the display panel while emitting light in greyscale according to image data.

The image data is transmitted from a data processing device called a timing controller to a data driving device called a source driver. The image data is transmitted as a digital value, and the data driving device converts the image data into an analog voltage to drive each pixel.

Since the image data indicates the greyscale value of each pixel individually or independently, the amount of the image data increases along with an increase in the number of pixels arranged in the display panel. The amount of image data to be transmitted in unit time increases along with an increase in a frame rate.

As the display panel has recently become higher resolution, both the number of pixels arranged in the display panel and the frame rate have increased. In order to process the amount of image data increased according to the higher resolution, data communication in a display device needs to be speeded up.

SUMMARY

In this background, an aspect of the present disclosure is to provide a technique for speeding up data communication in a display device.

In order to solve the above technical problem, an embodiment provides a technique for performing both high-speed data communication and low-speed data communication, and transmitting a configuration value for the high-speed data communication through the low-speed data communication.

Another embodiment provides a data processing device connected by communication lines with a data driving device configured to drive pixels using image data, comprising a first communication unit configured to transmit the image data to the data driving device through a first communication line at a first data rate; and a second communication unit configured to receive, as a feedback, a training state of a first clock for receiving the image data from the data driving device through a second communication line, wherein the first communication unit, before transmitting the image data, transmits a set value for transmitting and receiving the image data through the first communication line at a second data rate which is lower than the first data rate.

The data processing first communication unit may indicate, using the set value, the data rate of the image data, the use of a scramble, or the use of a limited run length code (LRLC).

The data processing first communication unit may further comprise a commander by which communication signals at the second data rate are generated and the second communication unit may receive, as a feedback, a receiving state of the communication signals at the second data rate through the second communication line.

The data processing first communication unit may transmit the image data at the first data rate in a display communication mode and at the second data rate in a command communication mode, and the voltage of the first communication line may be maintained as a predetermined DC voltage for a predetermined time between the command communication mode and the display communication mode.

The display communication mode may include a clock training time period and a link training time period and when a clock training is completed in the data driving device, the voltage of the second communication line may be changed from a first level to a second level.

The data processing first communication unit may transmit the set value using a Manchester code in which two unit times constitute one bit and, if signals of different voltage levels are assigned to the two unit times constituting one bit, the corresponding bit represents zero.

The data processing first communication unit may transmit the set value using a communication protocol including a first time period and a second time period, and it may transmit zero data in the first time period and the set value in the second time period.

The data driving device may train a second clock for a communication at the second data rate using the zero data received in the first time period and transmit a training state of the second clock as a feedback through the second communication line.

The data processing first communication unit may transmit a start message in a first phase in the second time period, a data message including the set value in a second phase therein, and a checksum message including a checksum value in a third phase therein.

The data processing first communication unit may transmit a plurality of equalizer (EQ) test signals before transmitting the image data and the data driving device may receive the plurality of EQ test signals using different equalizer set values, each applied to each EQ test signal in order to search for an equalizer set value with which the receiving rate of the EQ test signal is high.

Still another embodiment provides a data driving device configured to convert image data into a data voltage and to drive a pixel using the data voltage, comprising: a first communication unit configured to receive the image data through a first communication line from a data processing device at a first data rate; and a second communication unit configured to transmit, as a feedback, a training state of a first clock for receiving the image data to the data processing device through a second communication line, wherein the first communication unit receives a set value for transmitting and receiving the image data through the first communication line at a second data rate which is lower than the first data rate.

The data driving device may further comprise at least one of a descrambler configured to restore received data in a scrambled state into data in an original state and a decoder configured to decode data according to a Limited Run Length Code (LRLC) method.

The data driving first communication unit may receive a value indicating, using the set value, the data rate of the image data, the use of a scramble, or the use of a LRLC.

The data driving first communication unit, before receiving the image data, may receive a plurality of equalizer (EQ) test signals using different equalizer set values, each applied to each EQ test signal in order to search for an equalizer set value with which the receiving rate of an EQ test signal is high.

The EQ test signal may consist of an EQ clock pattern and EQ link data, and the first communication unit may train the first clock using the EQ clock pattern and train a link clock using the EQ link data.

The EQ link data may consist of first EQ link data and second EQ link data, wherein the first EQ link data may include a pattern in which symbol sets each comprising a plurality of symbols are repeated and the second EQ link data may consist of DC-balanced and scrambled zero symbols.

The EQ link data may consist of first EQ link data and second EQ link data, wherein the first communication unit may train a link clock using the first EQ link data, the EQ clock pattern and the first EQ link data may be received in a frame vertical blank time period in a frame time period, and the second EQ link data may be received in a frame active time period therein.

Still another embodiment provides a system comprising; a plurality of data driving devices, each configured to convert image data into a data voltage and to drive a pixel using the data voltage; and a data processing device configured to transmit the image data to the data driving device through a first communication line at a first data rate, wherein the data processing device transmits, before transmitting the image data, a set value for transmitting and receiving the image data through the first communication line at a second data rate which is lower than the first data rate.

Each of the plurality of data driving devices may transmit, as a feedback, a training state of a first clock for receiving the image data through a second communication line, wherein the second communication line may be connected in a cascade form.

Each of the plurality of data driving devices may transmit a feedback for communication, which is transmitted and received at the second data rate through the first communication line, to the data processing device through the second communication line.

As described above, according to the present disclosure, it is possible to speed up data communication in a display device.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
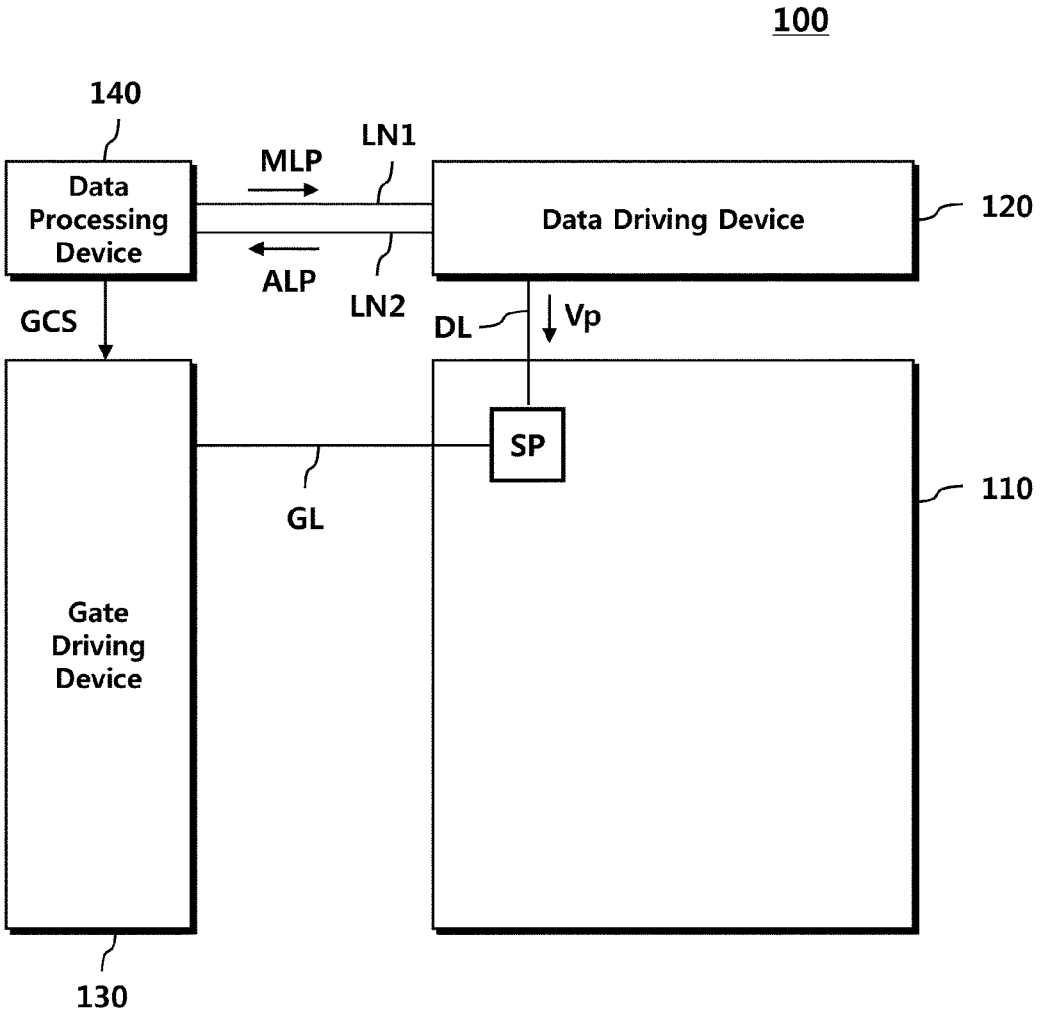
FIG. 1 is a block diagram illustrating a display device according to an embodiment.

FIG. 1 is a block diagram illustrating a display device according to an embodiment.

Referring to FIG. 1, a display device 100 may include a display panel 110, a data driving device 120, a gate driving device 130, and a data processing device 140.

On the display panel 110, a plurality of data lines DL and a plurality of gate lines GL may be disposed, and a plurality of pixels may be disposed. The pixel may be composed of a plurality of subpixels SP. Here, the subpixels SP may be red (R), green (G), blue (B), white (W), or the like. One pixel may be composed of SPs of RGB, SPs of RGBG, SPs of RGBW, or the like. In the following description, for convenience of description, one pixel is described as being composed of subpixels SP of RGB.

The data driving device 120, the gate driving device 130, and the data processing device 140 may be devices that generate signals for displaying an image on the display panel 110.

The gate driving device 130 may supply a gate driving signal of a turn-on voltage or a turn-off voltage to the gate lines GL. When the gate driving signal of the turn-on voltage is supplied to the subpixels SP, the subpixels SP are connected to the data lines DL. When the gate driving signal of the turn-off voltage is supplied to the subpixels SP, the connection between the subpixels SP and the data lines DL is released. The gate driving device 130 may be called a gate driver.

The data driving device 120 may supply a data voltage Vp to the subpixels SP through the data lines DL. The data voltage Vp supplied to the data lines DL may be supplied to the subpixels SP according to the gate driving signal. The data driving device 120 may be called a source driver.

The data driving device 120 may include at least one integrated circuit. The at least one integrated circuit may be of a tape automated bonding (TAB) type or a chip on glass (COG) type, and may be connected to a bonding pad of the panel 110 or may be directly formed on the panel 110. According to some embodiments, the at least one integrated circuit may be integrated with the display panel 110. In addition, the data driving device 120 may be implemented in a chip-on-film (COF) type.

The data processing device 140 may supply a control signal to the gate driving device 130 and the data driving device 120. For example, the data processing device 140 may transmit, to the gate driving device 130, a gate control signal GCS enabling scanning to start. The data processing device 140 may output image data to the data driving device 120. In addition, the data processing device 140 may transmit a data control signal for controlling the data driving device 120 to supply a data voltage Vp to each of the subpixels SP. The data processing device 140 may be called a timing controller.

The data processing device 140 may transmit image data and a data control signal by using a main communication signal MLP with a clock embedded therein. Hereinafter, a communication signal including image data will be referred to as a main communication signal. However, since the present embodiment is not limited to such a name, the above-mentioned communication signal including image data may be referred to as a first communication signal.

The data driving device 120 may transmit a training state of the clock embedded in the main communication signal MLP to the data processing device 140 through an auxiliary communication signal ALP. Hereinafter, another communication signal distinguished from the main communication signal MLP will be referred to as an auxiliary communication signal. However, since the present embodiment is not limited to such a name, the above-mentioned other communication signal may be referred to as a second communication signal.

The data processing device 140 and the data driving device 120 may perform high-speed data communication using the main communication signal MLP. In the high-speed data communication, a data loss rate may vary depending on the configuration of a receiving side. The data processing device 140 may transmit configuration values for the high-speed data communication to the data driving device 120 through low-speed data communication.

The data processing device 140 may transmit test signals for high-speed data communication to the data driving device 120 through the main communication signal MLP before the high-speed data communication. For example, the data processing device 140 may transmit a test signal for an equalizer of the data driving device 120, and the data driving device 120 may optimally configure a gain of the equalizer or the like using such a test signal.

The data driving device 120 may feed back a state thereof to the data processing device 140 through the auxiliary communication signal ALP. The data driving device 120 may feed back a clock training state for high-speed data communication as the auxiliary communication signal ALP. A signal for the clock training state for high-speed data communication may be specifically called a LOCK signal, and the data driving device 120 may transmit the LOCK signal through the auxiliary communication signal ALP.

The data driving device 120 may feed back a reception state of the main communication signal MLP through the auxiliary communication signal ALP. The data driving device 120 may feed back a reception state of specific information transmitted through the main communication signal MLP, through the auxiliary communication signal ALP.

The main communication signal MLP may be transmitted and received through a first communication line LN1, and the auxiliary communication signal ALP may be transmitted and received through a second communication line LN2. The first communication line LN1 may be an AC differential signal line, and the second communication line LN2 may be a single communication line including a transistor-transistor line TTL or an open drain circuit. The data processing device 140 and the data driving device 120 may perform one-to-one communication through the first communication line LN1, and may perform cascade communication in a chain form through the second communication line LN2. As to the cascade communication, for example, when the data driving device 120 is composed of a plurality of integrated circuits, integrated circuits may be connected in a cascade form while the second communication line LN2 is connected between the adjacent integrated circuits, and at least one integrated circuit of the plurality of integrated circuits may be connected to the data processing device 140 through the second communication line LN2.

Figure 2:
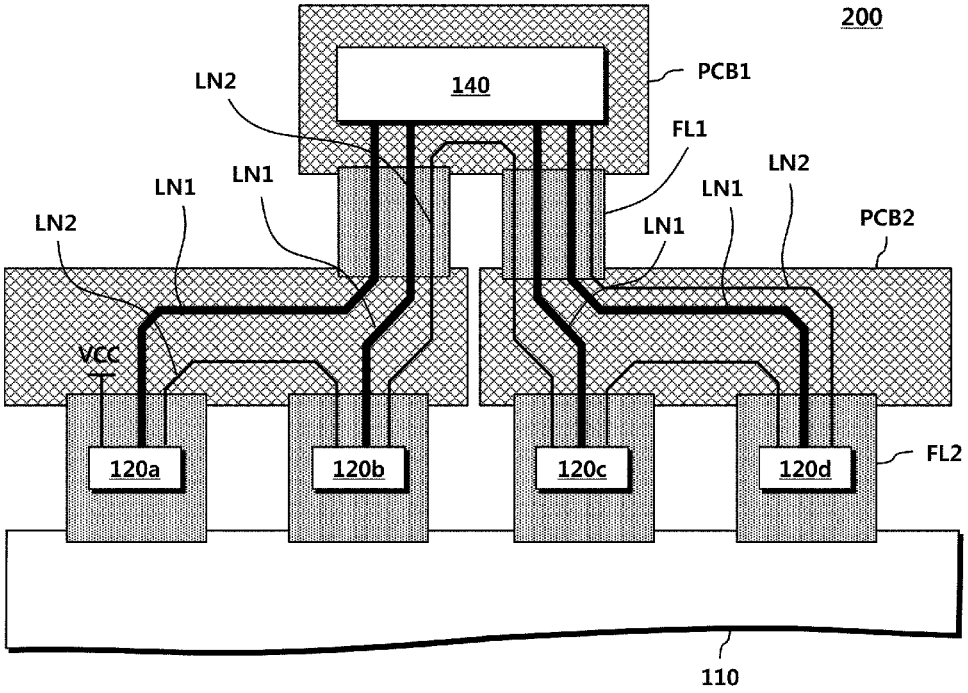
FIG. 2 is a block diagram illustrating a system according to an embodiment.

FIG. 2 is a block diagram illustrating a system according to an embodiment.

Referring to FIG. 2, the system may include at least one data processing device 140 and a plurality of data driving devices 120*a*, 120*b*, 120*c*, and 120*d*.

The data processing device 140 may be disposed on a first printed circuit board PCB1. The data processing device 140 may be connected to a plurality of data driving devices 120*a*, 120*b*, 120*c*, and 120*d* through a first communication line LN1 and a second communication link LN2.

The first communication line LN1 and the second communication line LN2 may reach the plurality of data driving devices 120*a*, 120*b*, 120*c*, and 120*d* via a first PCB PCB1 and a second PCB PCB2. The first PCB PCB1 and the second PCB PCB2 may be connected to a first film FL1 made of a flexible material. The first communication line LN1 and the second communication line LN2 may extend from the first PCB PCB1 to the second PCB PCB2 via such a first film FL1.

Each of the data driving devices 120*a*, 120*b*, 120*c*, and 120*d* may be disposed on a second film FL2 in the form of a COF. The second film FL2 may be a support substrate made of a flexible material that connects the second PCB PCB2 and the panel 110. The first communication line LN1 and the second communication line LN2 may extend from the second PCB PCB2 to each of the data driving devices 120*a*, 120*b*, 120*c*, and 120*d* via the second film FL2.

The first communication line LN1 may be connected one-to-one between the data processing device 140 and the data driving devices 120*a*, 120*b*, 120*c*, and 120*d*.

The second communication line LN2 may be connected between the respective data driving devices 120*a*, 120*b*, 120*c*, and 120*d* or between the data driving device 120*d* and the data processing device 140 while the second communication line LN2 does not overlap the first communication line LN1 in plan view. For example, the first data driving device 120*a* may be connected to the second data driving device 120*b* through the second communication line LN2, and the second data driving device 120*b* may be connected to the third data driving device 120*c* through the second communication link LN2. In this case, each of the second data driving device 120*b* and the third data driving device 120*c* may be connected to a different second PCB PCB2, and thus, the second communication line LN2 disposed therebetween may connect the second data driving device 120*b* and the third data driving device 120*c* via the second PCB PCB2, the first film FL1, and the first PCB PCB1. The third data driving device 120*c* may be connected to the fourth data driving device 120*d* through the second communication line LN2, and the fourth data driving device 120*d* may be connected to the data processing device 140 through the second communication line LN2.

Figure 3:
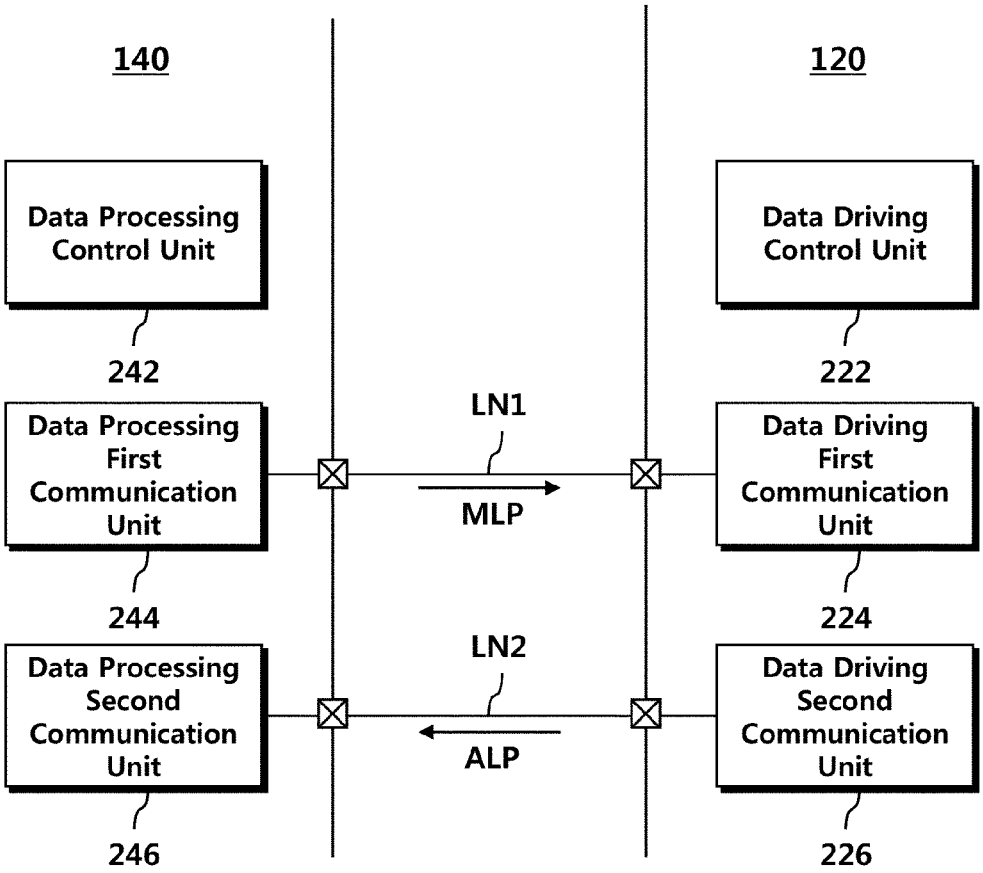
FIG. 3 is a diagram illustrating a configuration of each of a data processing device and a data driving device according to an embodiment and a connection relationship therebetween.

FIG. 3 is a diagram illustrating a configuration of each of a data processing device and a data driving device according to an embodiment and a connection relationship therebetween.

Referring to FIG. 3, the data processing device 140 may include a data processing control unit 242, a data processing first communication unit 244, and a data processing second communication unit 246. The data driving device 120 may include a data driving control unit 222, a data driving first communication unit 224, and a data driving second communication unit 226.

The data processing first communication unit 244 and the data driving first communication unit 224 may be connected to each other through the first communication line LN1. In addition, the data processing first communication unit 244 may transmit a main communication signal MLP to the data driving first communication unit 224 through the first communication line LN1.

The data processing second communication unit 246 and the data driving second communication unit 226 may be connected to each other through the second communication line LN2. The data processing second communication unit 246 and the data driving second communication unit 226 may transmit and receive an auxiliary communication signal ALP through the second communication line LN2.

The main communication signal MLP may include image data indicating a greyscale value for a pixel, and the auxiliary communication signal ALP may include a signal indicating a clock training state in the data driving device 120, for example, a LOCK signal.

Figure 4:
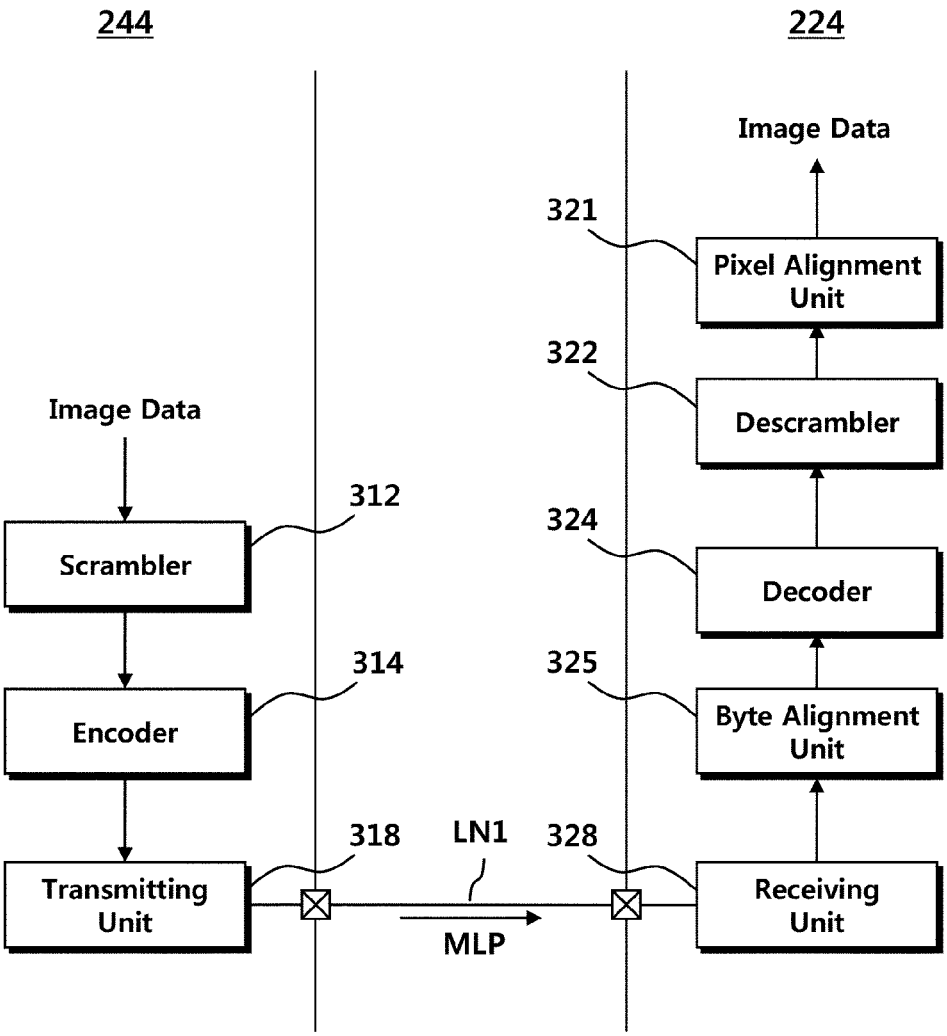
FIG. 4 is a block diagram illustrating each of a first communication unit of a data processing device and a first communication unit of a data driving device according to an embodiment.

FIG. 4 is a block diagram illustrating each of a first communication unit of a data processing device and a first communication unit of a data driving device according to an embodiment.

Referring to FIG. 4, the data processing first communication unit 244 may include a scrambler 312, an encoder 314, and a transmitter 318, and the data driving first communication unit 224 may include a receiver 328, a byte alignment unit 325, a decoder 324, a descrambler 322, and a pixel alignment unit 321.

Data, for example, image data is scrambled by the scrambler 312. Scrambling is a process of mixing respective bits of data to be transmitted, which may prevent the same bit (e.g., 1 or 0) from being consecutively placed more than K times (where K is a natural number of two or more) in a transmission stream of data. Scrambling is performed according to a previously promised protocol, and the descrambler 322 may perform a function of restoring a stream in which respective bits are mixed back to original data.

The scrambler 312 may selectively scramble some pieces of data of the main communication signal MLP. For example, the scrambler 312 may scramble and transmit only a portion of zero data of a test signal (hereinafter, referred to as an "EQ test signal") for an equalizer. More specific details thereof will be described later.

The encoder 314 may encode P bits of a transmission stream into Q bits in the corresponding data. Here, P may be, for example, 8 and Q may be, for example, 10. Encoding 8-bit data into 10-bit data is referral to as 8B10B encoding. 8B10B encoding is a method of encoding the corresponding data into a DC balance code.

The encoder 314 may encode the corresponding data such that the bits of a transmission stream are incremented. The encoded data can then be decoded into a DC balance code, e.g., 8B10B by a decoder 324. In another aspect, the encoded data may be restored to the original bit by the decoder 324.

The encoder 314 can use a limited run length code (LRLC) in the encoding of the corresponding data. "Run length" means that the same bits are placed consecutively. LRLC controls specific bits in the middle of the corresponding data so that "run length" does not appear more than a certain size in the data.

When the encoder 314 encodes data using the LRLC, the decoder 324 may decode the data according to the LRLC scheme used by the encoder 314.

Data transmitted in parallel in the data processing device may be serially converted for transmission between the data processing device and the data driving device. The serial-to-parallel conversion of data in the data processing device may be performed by a P2S conversion unit (not shown). In the data driving device, the S2P conversion unit (not shown) may perform a function of converting serially received data in parallel.

The serially converted data may be transmitted to the data driving device through a transmitter 318 of the data processing device. In this case, the data may be transmitted through a first communication line LN1 in the form of a main communication signal MLP.

The data received by the data driving device may be transmitted to a receiver 328, a byte alignment unit 325, a decoder 324, a descrambler 322, and a pixel alignment unit 321.

The transmitter 318 may transmit data through at least one first communication line LN1. Each first communication line LN1 may be composed of two signal lines to transmit a signal in a differential manner. When a plurality of first communication lines LN1 are used, the transmitter 318 may distribute data to the plurality of first communication lines LN1 and transmit the data. In addition, the receiver 328 may configure data by collecting signals received by being distributed through the plurality of first communication lines LN1.

The data driving device may train a data link, for example, a symbol clock or a pixel clock, according to link data included in the main communication signal MLP. The byte alignment unit 325 and the pixel alignment unit 321 may align data in byte units, for example, in symbol and pixel units, according to the trained data link.

The byte alignment unit 325 may align data in byte units. The byte units are basic units constituting information included in data, and may be, for example, 8 bits, 10 bits, or the like. The byte alignment unit 325 may align data so that serially transmitted data can be read off in byte units.

The pixel alignment unit 321 may align data in pixel units. The data may sequentially include information corresponding to subpixels such as RGB. The pixel alignment unit 321 may align data so that serially transmitted data can be read off in pixel units.

When image data is aligned in pixel units by the pixel alignment unit 321, greyscale data, for example, image data can be generated for each subpixel.

Figure 5:
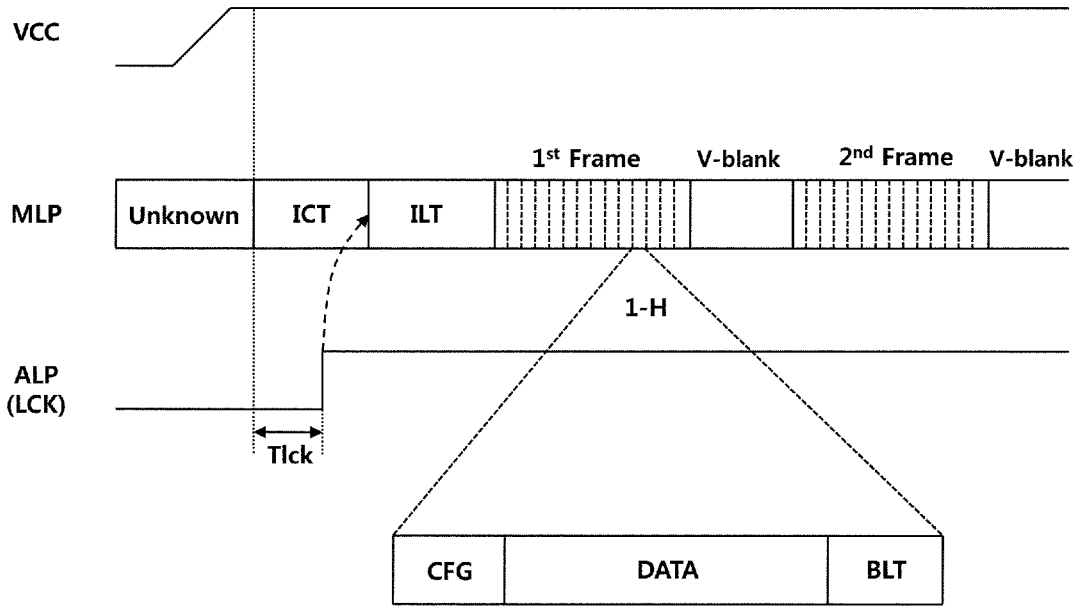
FIG. 5 is a diagram illustrating a first example of the sequence of a main communication signal and an auxiliary communication signal in a display device according to an embodiment.

FIG. 5 is a diagram illustrating a first example of the sequence of a main communication signal and an auxiliary communication signal in a display device according to an embodiment. In FIG. 5, the waveform of a driving voltage VCC supplied to the data processing device and the data driving device is illustrated in an auxiliary manner.

When the driving voltage VCC is supplied to the data processing device, the data processing device may transmit a clock pattern to the data driving device within a predetermined time. The clock pattern may be included in the main communication signal MLP and transmitted.

The data driving device may receive the clock pattern and may train a clock according to the clock pattern. After completing the training of the clock, the data driving device may change the voltage of the auxiliary communication signal ALP formed in the second communication line from a first signal level, for example, a low voltage level to a second signal level, for example, a high voltage level.

The data processing device and the data driving device may perform communication using a phase locked loop (PLL) method. In this method, the data driving device may generate an internal clock according to the frequency and phase of the clock pattern.

The data driving device may complete clock training within a training time limit Tlck. The data processing device may transmit the clock pattern during an initial clock training (ICT) time period longer than the training time limit Tlck, including a predetermined margin time.

Clock training may be performed at an initial stage for transmitting data. In addition, when a link between the data processing device and the data driving device is broken, clock training may be performed again.

After clock training is completed, the data processing device may transmit link data through the main communication signal MLP.

The data driving device may receive the link data in accordance with the clock and may train the data link in accordance with the link data. Link training may be performed during an initial link training (ILT) time period during which the data processing device transmits the link data.

Link training may be performed at an initial stage for transmitting data. If the link between the data processing device and the data driving device is broken, link training may be performed again.

After link training is completed, the data processing device may transmit image data through the main communication signal MLP.

The image data may be transmitted for each frame. In addition, a frame vertical blank time period (V-blank) may exist in an interval between transmission of image data for each frame. In the time period of one frame, the remaining time period except the frame vertical blank time period may be referred to as a frame active time period.

One frame time period may include a plurality of sub-time periods, and image data may be transmitted in one time period of each sub-time period.

For example, one frame time period may include a plurality of horizontal (H) time periods (1-H, horizontal period) respectively corresponding to a plurality of lines of a display panel. The data processing device may transmit image data corresponding to each line for each H time period 1-H.

The H time period 1-H may be composed of, for example, a configuration transmission section, an image transmission section, and a horizontal blank section in terms of a data processing device. The data processing device may transmit image data in the image transmission section of each H time period 1-H. In terms of the data driving device, the H time period 1-H may be composed of a configuration reception section CFG an image recption section DATA, and a horizontal blank section BLT. In addition, the data driving device may receive image data in the image reception section DATA.

The data driving device may receive image data in the image reception section DATA and may align the image data according to the data link. Since the image data is transmitted without a separate clock or link signal, the image data should be read off properly in the data driving device. The data driving device can align the image data in accordance with the above-described data link and can read off appropriately.

The data driving device may check configuration data, image data, or link data, and may generate a fail signal when the configuration data, the image data, or the link data deviates from a predefined rule. The fail signal indicates that a link between the data processing device and the data driving device is broken. The data driving device may count the failing signals, and may transmit a signal for changing a clock training state through a second communication line connected to the data processing device when the fail signal occurs more than N times (N is a natural number).

When the clock training state is changed, the data processing device may retransmit the clock pattern during the initial clock training (ICT) time period and may retransmit the link data during the initial link training (ILT) time period as an initial stage. In addition, the data driving device may reperform a process of training a communication clock on the clock pattern and training the data link according to the link data.

Figure 6:
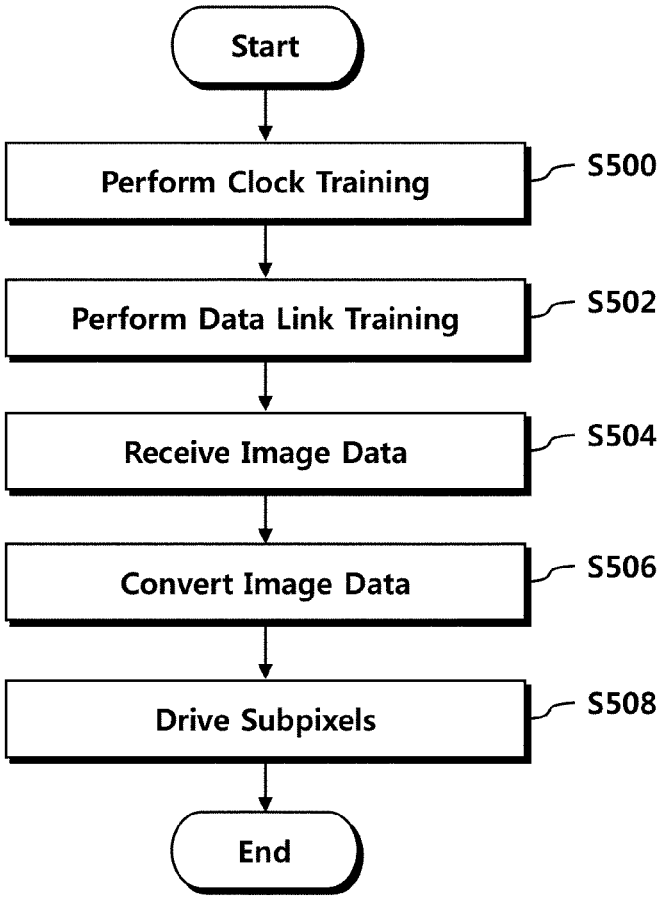
FIG. 6 is a flowchart illustrating a pixel driving method in a display device according to an embodiment.

FIG. 6 is a flowchart illustrating a pixel driving method in a display device according to an embodiment. The pixel driving method described with reference to FIG. 6 may be performed by the above-described data driving device.

Referring to FIG. 6, in operation S500, the data driving device may receive a clock pattern and may train a clock according to the clock pattern.

After the clock is trained, in operation S502, the data driving device may receive link data according to the clock and may train data link according to the link data. In operation S502 of training the data link, the data driving device may train the data link by performing byte unit alignment and pixel unit alignment of the link data.

After the data link is trained, in operation S504, the data driving device may receive image data according to the data link.

In operation S506, the data driving device may convert, for example, decode and descramble the image data according to information indicated by the link data.

In operation 508, the data driving device may drive subpixels using a data voltage generated through the conversion of the image data.

Figure 7:
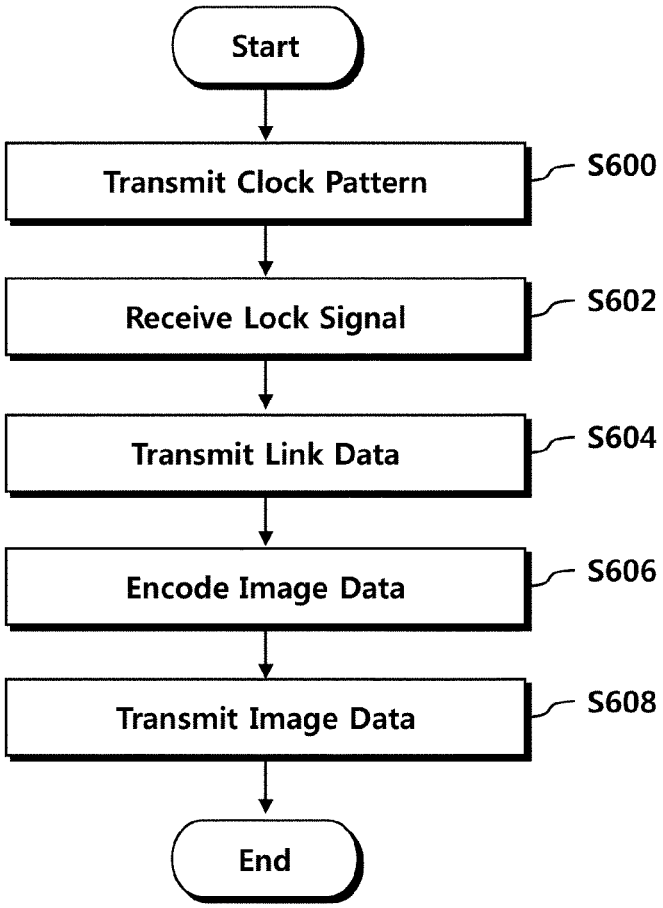
FIG. 7 is a flowchart illustrating a method of transmitting image data in a display device according to an embodiment.

FIG. 7 is a flowchart illustrating a method of transmitting image data in a display device according to an embodiment.

The method of transmitting image data described with reference to FIG. 7 may be performed by the above-described data processing device.

Referring to FIG. 7, in operation S600, the data processing device may transmit a clock pattern indicating a clock to the data driving device. The data driving device may train the clock according to the clock pattern. When training of the clock is completed, the data driving device may transmit a LOCK signal to the data processing device. Here, the LOCK signal is a signal indicating the completion state of the clock training among signals indicating a clock training state.

After receiving the LOCK signal in operation S602, the data processing device may transmit link data to the data driving device in operation S604. The data processing device may transmit the link data in synchronization with the clock.

The data processing device may encode the image data in operation S606, and may transmit the encoded image data to the data driving device in operation S608.

Operation S606 of encoding the image data may include scrambling the image data, encoding the image data with LRLC, or the like.

The data processing device and the data driving device may perform both high-speed data communication and low-speed data communication. The above-described transmission and reception of the image data may be performed through high-speed data communication. As described with reference to FIGS. 5 to 7, a mode for training a clock and a link for high-speed data communication and transmitting and receiving image data and configuration data according to the trained clock and link is generally called a display communication mode. In the display communication mode, after clock training and link training are performed, transmission and reception of image data and configuration data in units of frames may be repeated.

In the display communication mode, since data is transmitted and received through high-speed data communication, the reception rate of data may vary depending on a configuration value for communication. In order to increase the reception rate and facilitate high-speed data communication, the data processing device and the data driving device may transmit and receive information for supporting the high-speed data communication through the low-speed data communication.

Figure 8:
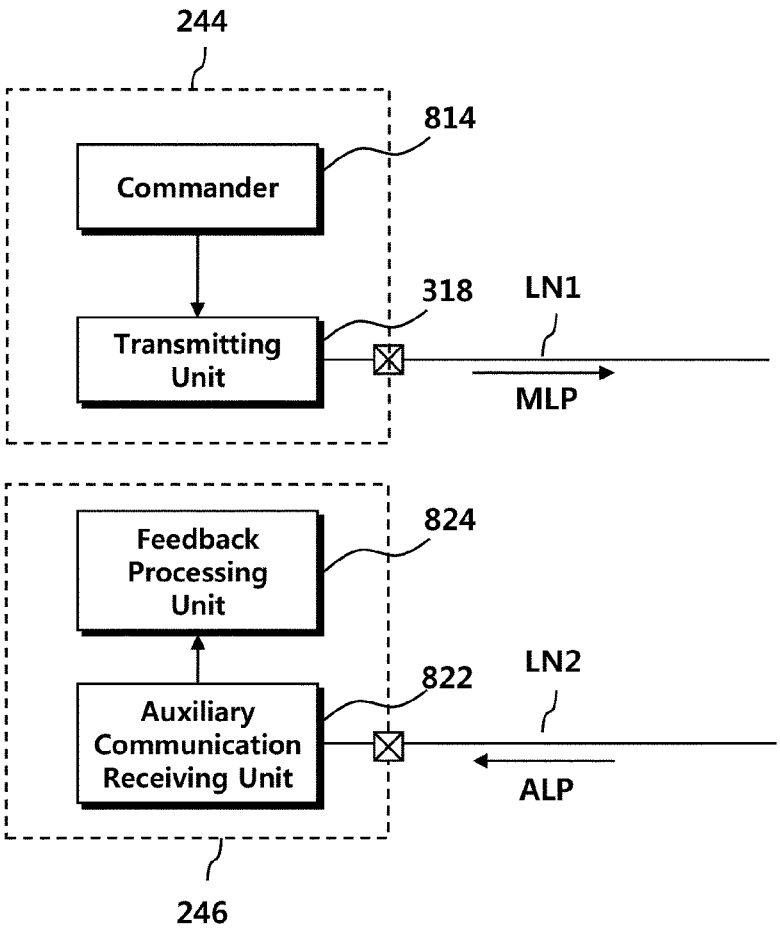
FIG. 8 is a diagram illustrating a state in which a data processing device further includes components for low-speed data communication according to an embodiment.

FIG. 8 is a diagram illustrating a state in which a data processing device further includes components for low-speed data communication according to an embodiment.

Referring to FIG. 8, the data processing first communication unit 244 may further include a commander 814 capable of performing low-speed data communication through the main communication signal MLP of the first communication line LN1. In addition, the data processing second communication unit 246 may further include a feedback processing unit 824 capable of receiving feedback for low-speed data communication through the auxiliary communication signal ALP of the second communication line LN1 and an auxiliary communication receiver 822.

The commander 814 may transmit a low-speed main communication signal MLP having a low data rate to the first communication line LN1. Here, the high-speed data communication may have a data rate five times higher than that of the low-speed data communication. The commander 814 may indicate whether to transmit, for example, an equalizer test signal through low-speed data communication, may indicate the data rate of high-speed data communication, may indicate whether to use LRLC, may indicate whether to use scrambling, and may indicate values indicated by previous pin setting.

The commander 814 may generate a low-speed main communication signal MLP and may transmit the generated low-speed main communication signal MLP to the first communication line LN1 through the transmitter 318.

The data driving device may feed back the reception state of the low-speed data communication through the auxiliary communication signal ALP of the second communication line LN2. The auxiliary communication receiver 822 may transmit a state signal received through the auxiliary communication signal ALP, such as a signal for the reception state of the low-speed data communication or a LOCK signal, to the feedback processing unit 824, and the feedback processing unit 824 may determine the state of the data driving device by analyzing the auxiliary communication signal ALP. The overall configuration of the data processing device may be controlled by the data processing control unit. For example, the data processing control unit may confirm information transmitted through the commander 814, and may determine the state of the data driving device received through the auxiliary communication signal ALP to confirm whether the corresponding information is correctly transmitted and received.

Figure 9:
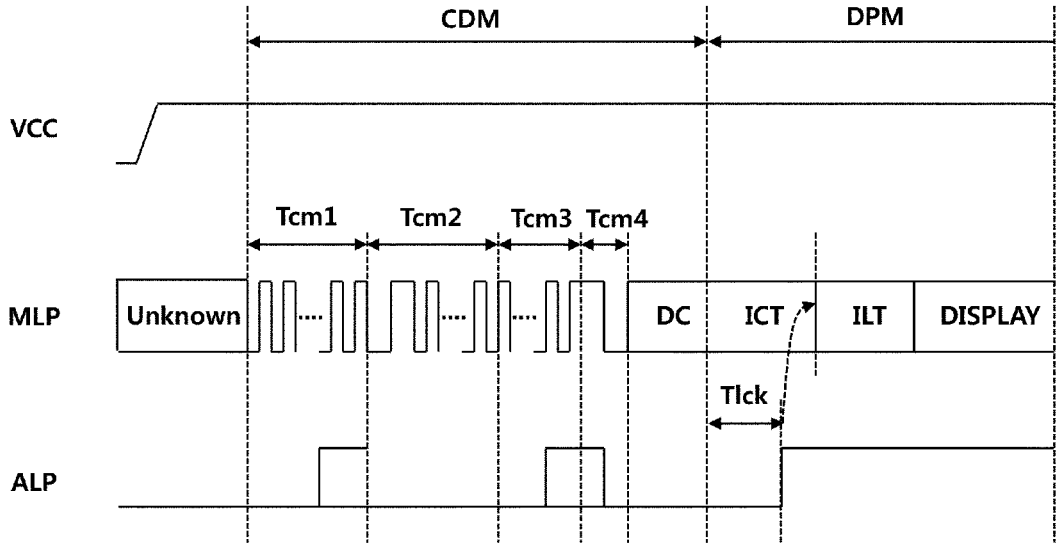
FIG. 9 is a diagram illustrating a second example of the sequence of a main communication signal and an auxiliary communication signal in a display device according to an embodiment.

FIG. 9 is a diagram illustrating a second example of the sequence of a main communication signal and an auxiliary communication signal in a display device according to an embodiment.

Referring to FIG. 9, the data processing device and the data driving device may perform low-speed data communication in a command communication mode CDM before performing high-speed data communication in a display communication mode DPM.

The command communication mode CDM may include a DC section. In the DC section, a main communication signal may maintain a predetermined DC voltage. The data processing device and the data driving device may recognize a change in the mode through the DC section.

Figure 10:
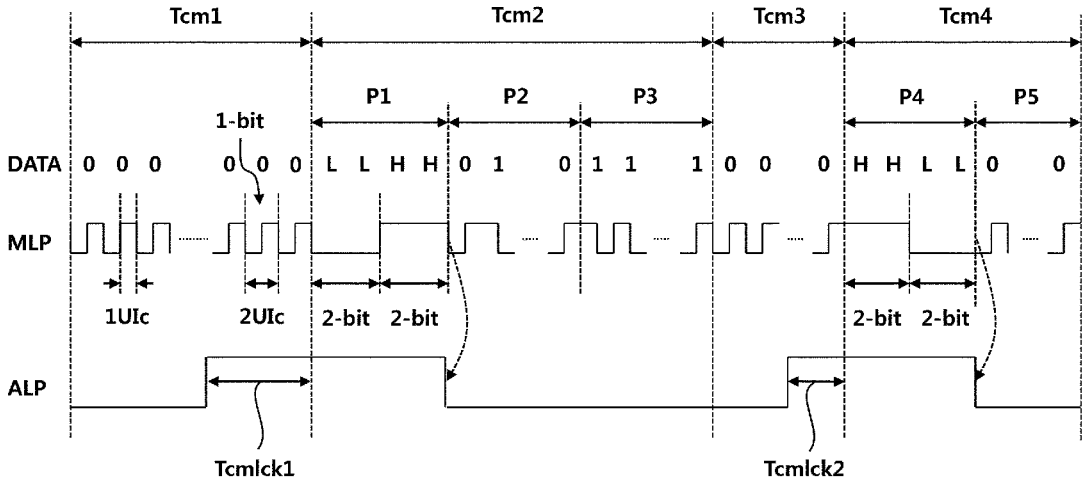
FIG. 10 is a diagram illustrating a first example of a detailed sequence of a command communication mode according to an embodiment.

FIG. 10 is a diagram illustrating a first example of a detailed sequence of a command communication mode according to an embodiment. In FIG. 10, the DC section included in the command communication mode is omitted.

Referring to FIG. 10, the command communication mode may include a first time period Tcm1, a second time period Tcm2, a third time period Tcm3, and a fourth time period Tcm4.

In the first time period Tcm1, zero data may be transmitted/received as the main communication signal MLP. In the command communication mode, a signal may be encoded with a Manchester code, for example, a Manchester II code. In the Manchester code, in which two unit times 2UIc constitute one bit and, if signals of different voltage levels are assigned to the two unit times constituting one bit, the corresponding bit represents zero. The first time period Tcm1 may be composed of bits representing zero.

The data processing device may transmit zero data in the first time period Tcm1, and the data driving device may restore the clock of the low-speed data communication using the zero data.

When the clock of the low-speed data communication is restored in the first time period Tcm1, the data driving device may change the auxiliary communication signal ALP from a first signal level to a second signal level to inform the data processing device that the clock has been restored.

The data processing device may confirm that the clock has been restored through the auxiliary communication signal ALP, and may transmit a signal of the second time period Tcm2 as the main communication signal MLP after a first predetermined time Tcmlck1 elapses.

The data processing device may transmit data to be transmitted through the low-speed data communication in the second time period Tcm2. The second time period Tcm2 may be divided into three phases P1, P2, and P3.

The data processing device may transmit a start message indicating the start of a message in the first phase P1. The start message may be composed of, for example, a 2-bit signal having a low level and a 2-bit signal having a high level. In this case, the data processing device may not use the Manchester code in the start message. The data driving device may receive the start message, and may change the auxiliary communication signal from the second signal level to the first signal level as a feedback thereto.

The data processing device may transmit a data message including information in the second phase P2. The data message may include at least one byte, and each byte may consist of 8 bits.

The data processing device may transmit a checksum message including a checksum value in the third phase P3. The data processing device may enable a value obtained by checksuming on each byte to be included in the checksum message and may transmit the checksum message.

The data processing device may transmit zero data in the third time period Tcm3 subsequent to the second time period Tcm2. The data driving device may confirm the zero data of the third time period Tcm3 and may change the signal level of the auxiliary communication signal from the first signal level to the second signal level as a feedback thereto. According to an embodiment, the data driving device may retrain a clock for low-speed data communication in the third time period Tcm3.

The data processing device may transmit an end message and the zero data in the fourth time period Tcm4. The fourth time period Tcm4 may be divided into two phases P4 and P5. The end message may be transmitted in the fourth phase P4 and the zero data may be transmitted in the fifth phase P5. The end message may be composed of, for example, a 2-bit signal having a high level and a 2-bit signal having a low level. In this case, the data processing device may not use the Manchester code in the end message. The data driving device may receive the end message, and may change the auxiliary communication signal from the second signal level to the first signal level as a feedback thereto. The fourth time period Tcm4 may include zero data, and the zero data may be transmitted in case the end message or the like is not recognized by the data driving device.

Figure 11:
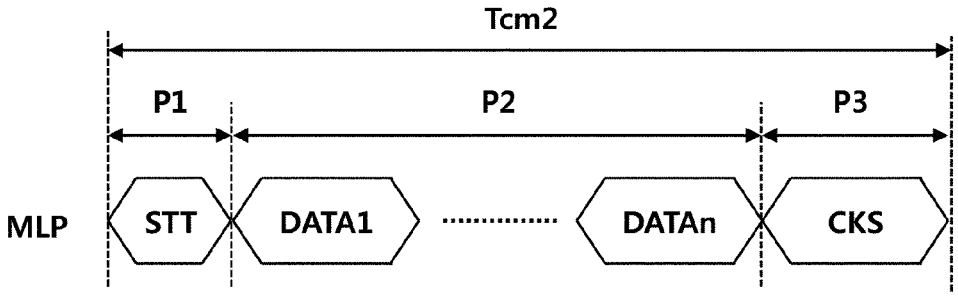
FIG. 11 is a configuration diagram illustrating a message of a second time period in low-speed data communication according to an embodiment.

FIG. 11 is a configuration diagram illustrating a message of a second time period in low-speed data communication according to an embodiment.

Referring to FIG. 11, in the second time period Tcm2, a message may include a start message STT disposed in a first phase P1, data messages DATA1 to DATAn disposed in a second phase P2, and a checksum message CKS.

The start message STT may have a size of 4 bits and may not be Manchester coded.

The data messages DATA1 to DATAn may be composed of a plurality of bytes, and each byte may be composed of 8 bits.

The checksum message CKS may include values obtained by checksuming respective bytes of the data messages DATA1 to DATAn. If the values obtained by checksuming the received data messages DATA1 to DATAn are different from values included in the checksum message CKS, the data driving device may ignore information included in the data messages DATA1 to DATAn.

Figure 12:
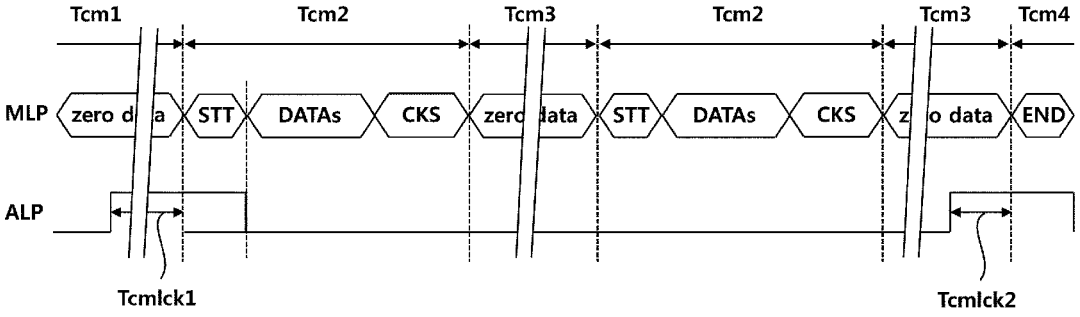
FIG. 12 is a diagram illustrating a third example of the sequence of a main communication signal and an auxiliary communication signal in a display device according to an embodiment.

FIG. 12 is a diagram illustrating a third example of the sequence of a main communication signal and an auxiliary communication signal in a display device according to an embodiment.

The data driving device may confirm the checksum message CKS in the second time period Tcm2, and may change the auxiliary communication signal ALP from the first signal level to the second signal level in the third time period Tcm3 when the checksum is normal. However, when it is determined that the checksum is abnormal in the second time period Tcm2, the data driving device may maintain the signal level of the auxiliary communication signal ALP in the third time period Tcm3. When the data processing device confirms that the signal level of the auxiliary communication signal ALP is maintained without being changed, the data processing device may transmit the messages of the second time period Tcm2 again.

Meanwhile, to enhance a communication function, the data driving device may further include an equalizer, and the data processing device may further transmit test signals for testing the equalizer through the main communication signal.

Figure 13:
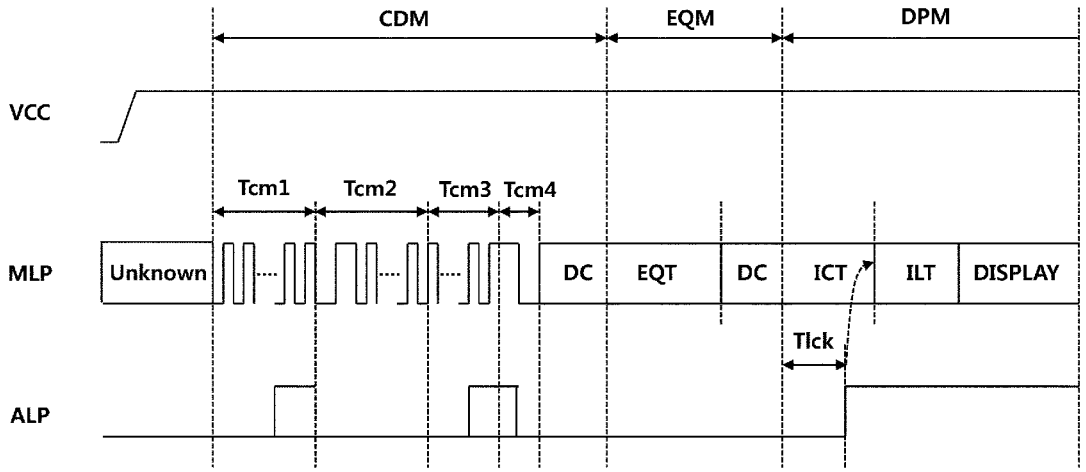
FIG. 13 is a diagram illustrating a fourth example of the sequence of a main communication signal and an auxiliary communication signal in a display device according to an embodiment.

FIG. 13 is a diagram illustrating a fourth example of the sequence of a main communication signal and an auxiliary communication signal in a display device according to an embodiment.

Referring to FIG. 13, an equalizer test mode EQM may be further disposed between the command communication mode CDM and the display communication mode DPM.

The data processing device may transmit a plurality of EQ test signals in the equalizer test mode EQM. The data driving device may apply a different equalizer configuration value to each EQ test signal and may search for an optimal configuration value for the equalizer.

The equalizer test mode EQM may be divided into an EQ test signal section EQT and a DC section. The data processing device may transmit a plurality of EQ test signals as the main communication signal MLP in the EQ test signal section EQT. In addition, the data processing device may configure a predetermined time as the DC section after the EQ test signal section EQT to inform a change in the mode.

Figure 14:
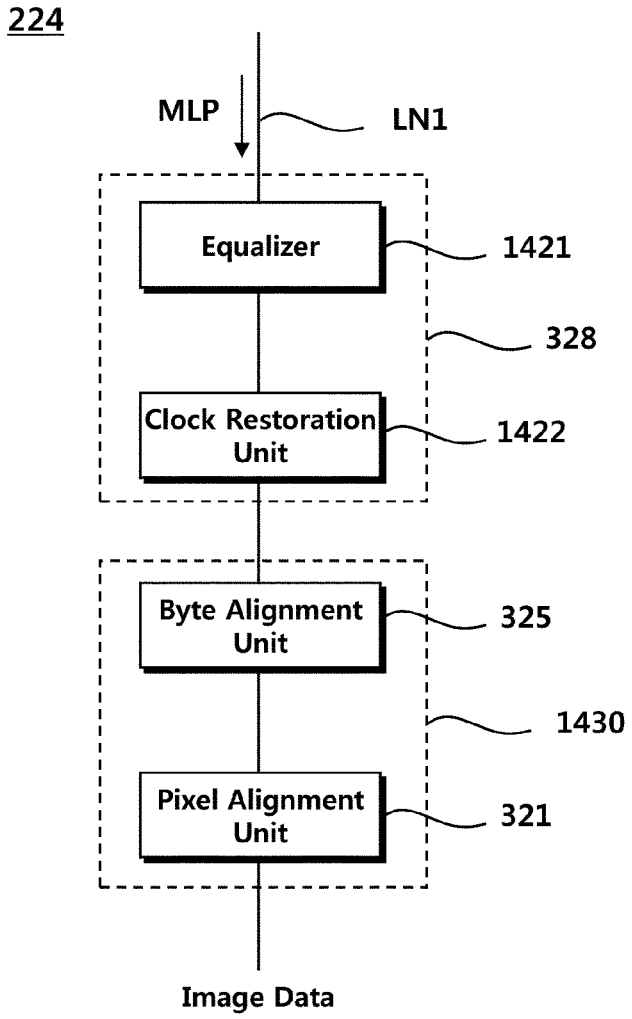
FIG. 14 is a block diagram illustrating a first communication unit showing an example in which an equalizer is further included in a first communication unit of a data driving device according to an embodiment.

FIG. 14 is a block diagram illustrating a first communication unit showing an example in which an equalizer is further included in a first communication unit of a data driving device according to an embodiment.

Referring to FIG. 14, the first communication unit 224 of the data driving device may include an equalizer 1421 and a clock restoration unit 1422 in the receiver 328.

The equalizer 1421 may adjust the main communication signal MLP received through the first communication line LN1 while being connected to the first communication line LN1. The equalizer 1421 may transmit the adjusted main communication signal MLP to the clock restoration unit 1422 and/or the byte alignment unit 325, and the pixel alignment unit 321, thereby enhancing the reception performance of the first communication unit 224 of the data driving device.

The equalizer 1421 may adjust the main communication signal MLP according to a configuration thereof. For example, the equalizer 1421 may store a gain as a configuration value, and may adjust an amplification gain of the main communication signal MLP according to the configured gain.

The clock restoration unit 1422 may receive a clock pattern through the main communication signal MLP and may train a first clock according to the clock pattern. In this case, the clock training performance of the clock restoration unit 1422 may be affected by the adjustment of the main communication signal MLP by the equalizer 1421.

A link restoration unit 1430 including the byte alignment unit 325 and the pixel alignment unit 321 may train a link clock, for example, a symbol clock or a pixel clock according to link data, and may align image data in byte units, for example, in symbol units and in pixel units according to the link clock. In this case, the link training performance or link restoration performance of the link restoration unit 1430 may be affected by the adjustment of the main communication signal MLP by the equalizer 1421.

Meanwhile, in order to automatically determine the optimal configuration of the equalizer, the data processing device may transmit a plurality of EQ test signals to the data driving device, and the data driving device may evaluate the reception performance of the plurality of EQ test signals under different configuration states of the equalizer, for example, the clock training performance of the clock restoration unit 1422 and the link restoration performance of the link restoration unit 1430, thereby searching for the optimal configuration value. The data processing device may transmit EQ test information before transmitting the EQ test signal so that the data driving device can evaluate the EQ test signal while changing the configuration of the equalizer. The EQ test information may include information about the configuration of the equalizer. For example, the EQ test information may include a configuration value for the gain of the equalizer. The data processing device may transmit the EQ test information so that the data driving device can configure the equalizer to have a specific configuration value, and may then transmit the EQ test signal so that the data driving device can evaluate the EQ test signal using the specific configuration value.

Figure 15:
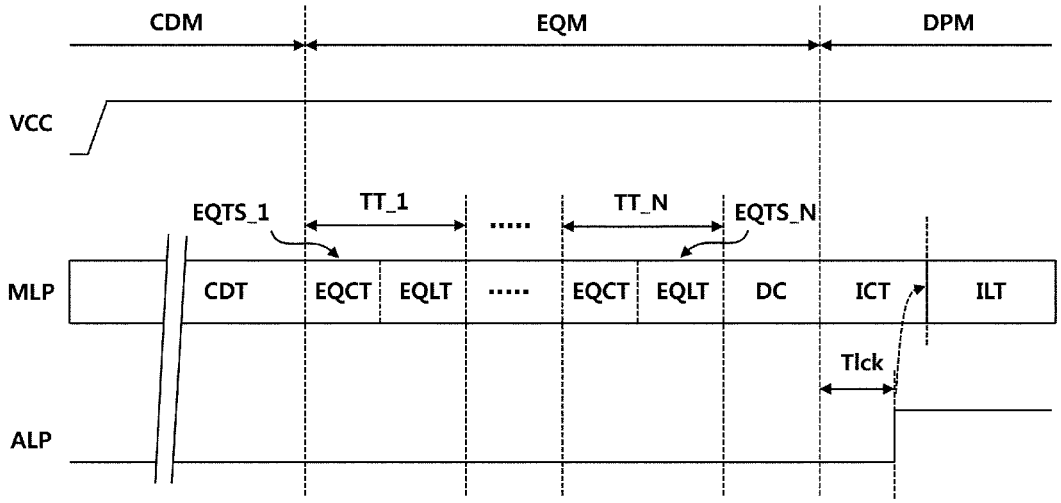
FIG. 15 is a diagram illustrating a fifth example of the sequence of a main communication signal and an auxiliary communication signal in a display device according to an embodiment.

FIG. 15 is a diagram illustrating a fifth example of the sequence of a main communication signal and an auxiliary communication signal in a display device according to an embodiment.

Referring to FIG. 15, the data processing device may transmit a plurality of EQ test signals EQTS_1 to EQTS_N through the main communication signal MLP in the time period of the equalizer test mode EQM corresponding to a time period before the initial clock training (ICT) time period.

The data driving device, for example, the control unit may evaluate the reception performance of the data driving device, for example, the first communication unit with respect to the EQ test signals EQTS_1 to EQTS_N received through the main communication signal MLP for each configuration state of the equalizer. In addition, the data driving device, for example, the control unit may determine an optimal configuration for the equalizer according to the evaluation result.

The EQ test signals EQTS_1 to EQTS_N may include a clock pattern. For example, some of the EQ test signals EQTS_1 to EQTS_N may include an EQ clock pattern EQCT.

The data driving device, for example, the first communication unit may recover a first clock from the EQ clock pattern, and the data driving device, for example, the control unit may evaluate the reception performance of the data driving device, for example, the first communication unit as a result of the restoration of the first clock.

The EQ test signals EQTS_1 to EQTS_N may include link data. For example, EQ link data EQLT may be included in some of the EQ test signals EQTS_1 to EQTS_N.

The data driving device, for example, the first communication unit may receive the EQ link data EQLT according to the restored first clock, and the data driving device, for example, the control unit may evaluate the reception performance of the data driving device, for example, the first communication unit using reception rates of a plurality of symbols.

The EQ link data EQLT may include a plurality of zero symbols that are direct current (DC)-balanced. DC-balanced may mean that the number of bits indicating 1 and the number of bits indicating 0 are the same. The zero symbol may be a symbol indicating 0 as a byte value.

The data driving device, for example, the control unit may evaluate the reception performance of the data driving device, for example, the first communication unit based on the reception rates of a plurality of zero symbols. The plurality of zero symbols may be scrambled. Being scrambled may mean that the positions of bits constituting a symbol are mixed. The data driving device, for example, the control unit may test different types of symbols by using the plurality of scrambled zero symbols.

The link data EQLT may include a plurality of first type symbols and a plurality of second type symbols. The plurality of first type symbols may be symbols for link training, and the plurality of second type symbols may be symbols for reception performance evaluation. For example, the plurality of first type symbols are composed of four different symbols representing red (R), green (G), blue (B), and white (W), and these four symbols may be repeatedly arranged in one section of the link data EQLT. The plurality of second type symbols may be composed of zero symbols.

The data driving device, for example, the first communication unit may restore a link clock, e.g., a symbol clock and/or a pixel clock as the plurality of first type symbols, and may restore the plurality of second type symbols according to the link clock. The data driving device, for example, the control unit may evaluate the reception performance of the data driving device, for example, the first communication unit based on whether the link clock is restored and/or the reception rates of the plurality of second type symbols.

The data driving device, for example, the control unit may configure the equalizer to have a configuration value of the equalizer having the highest reception performance. Alternatively, the data driving device, for example, the control unit may configure the equalizer to have an intermediate value of each configuration state for a plurality of configuration states evaluated for higher reception performance.

The data driving device, for example, the control unit may determine an optimal configuration for the equalizer and may transmit the determined configuration value to the data processing device using the auxiliary communication signal ALP. The data processing device, for example, the control unit may determine whether the received configuration value is similar to a pre-stored value, and may generate a signal of an error or a warning when a difference therebetween is large.

The data driving device, for example, the first communication unit may receive the EQ test signals EQTS_1 to EQTS_N within a time period after the data driving device is started and before the image data is received, and the data driving device, for example, the control unit may determine the optimal configuration for the equalizer before the image data is received.

The data processing device may transmit the EQ test signals EQTS_1 to EQTS_N at predetermined time intervals in N time periods TT_1 to TT_N, respectively. For example, the data processing device may transmit the EQ test signals EQTS_1 to EQTS_N for each frame time period in the N frame time periods. Alternatively, the data processing device may transmit the EQ test signals EQTS_1 to EQTS_N for each sub-time period obtained by dividing the frame active time period of one frame into N time periods.

The data processing device, for example, the control unit of the data processing device may repeat a periodic operation in units of frames. In order to equally apply the effect of noise caused by this operation to the respective EQ test signals EQTS_1 to EQTS_N, the data processing device may transmit the EQ test signals EQTS_1 to EQTS_N for each frame time period in the N frame time periods, or may transmit the EQ test signals EQTS_1 to EQTS_N for each sub-time period obtained by dividing the frame active time period of one frame into N time periods.

Figure 16:
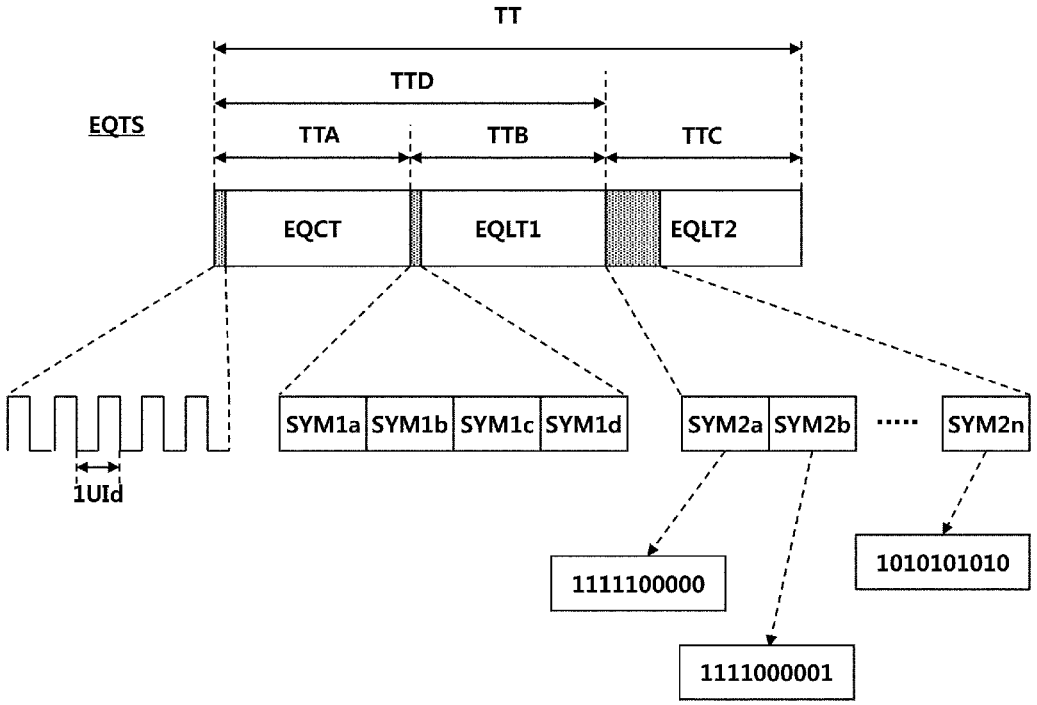
FIG. 16 is a configuration diagram illustrating an example of an EQ test signal according to an embodiment.

FIG. 16 is a configuration diagram illustrating an example of an EQ test signal according to an embodiment.

Referring to FIG. 16, the EQ test signal may include an EQ clock pattern EQCT, first EQ link data EQLT1, and second EQ link data EQLT2.

The EQ clock pattern EQCT may have a pattern repeated in clock units 1UI. The data driving device, for example, the first communication unit may train a clock and may restore a first clock using the EQ clock pattern EQCT.

The first EQ link data EQLT1 may include a symbol set consisting of three or four symbols. For example, the first EQ link data EQLT1 may include a symbol set composed of four first type symbols SYM1*a*, SYM1*b*, SYM1*c*, and SYM1*d*, and in the first EQ link data EQLT1, the symbol set may be arranged to be repeated. In addition, the data driving device, for example, the first communication unit may train a link clock, for example, symbol clock and/or a pixel clock using the first EQ link data EQLT1.

The second EQ link data EQLT2 may be composed of a plurality of scrambled second type symbols SYM2*a*, SYM2*b*, . . . , and SYM2*n*. The plurality of second type symbols SYM2*a*, SYM2*b*, . . . , and SYM2*n* may be DC-balanced zero symbols.

At a time TT at which one EQ test signal is transmitted, the EQ clock pattern EQCT may be transmitted for a first time TTA, the first EQ link data EQLT1 may be transmitted for a second time TTB subsequent to the first time TTA, and the second EQ link data may be transmitted for a third time ITC subsequent to the second time TTB.

The time TT at which the EQ test signal is transmitted may be equal to a frame time or equal to 1/N of the frame active time.

Figure 17:
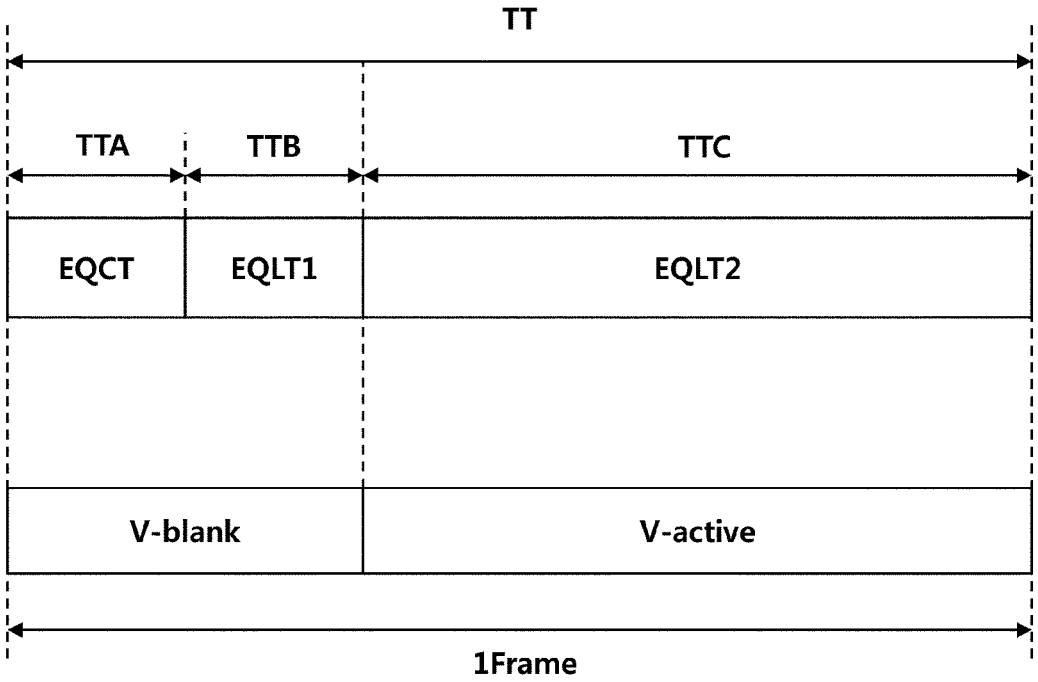
FIG. 17 is a diagram illustrating a comparison between a frame time and a time of an EQ test signal according to a first example in an embodiment.

FIG. 17 is a diagram illustrating a comparison between a frame time and a time of an EQ test signal according to a first example in an embodiment.

Referring to FIG. 17, the time TT at which the EQ test signal is transmitted may be equal to one frame time. A first time TTA at which the EQ clock pattern EQCT is transmitted and a second time TTB at which first EQ link data EQLT1 is transmitted may be included in a frame vertical blank time period V-blank. A third time TTC at which second EQ link data EQLT2 is transmitted may be included in a frame active time period V-active.

In addition, the plurality of EQ test signals according to the time configuration may be periodically transmitted in frame time units. According to the first example, the configurations of the equalizer may be more accurately compared by putting all the EQ test signals in substantially the same environment.

Figure 18:
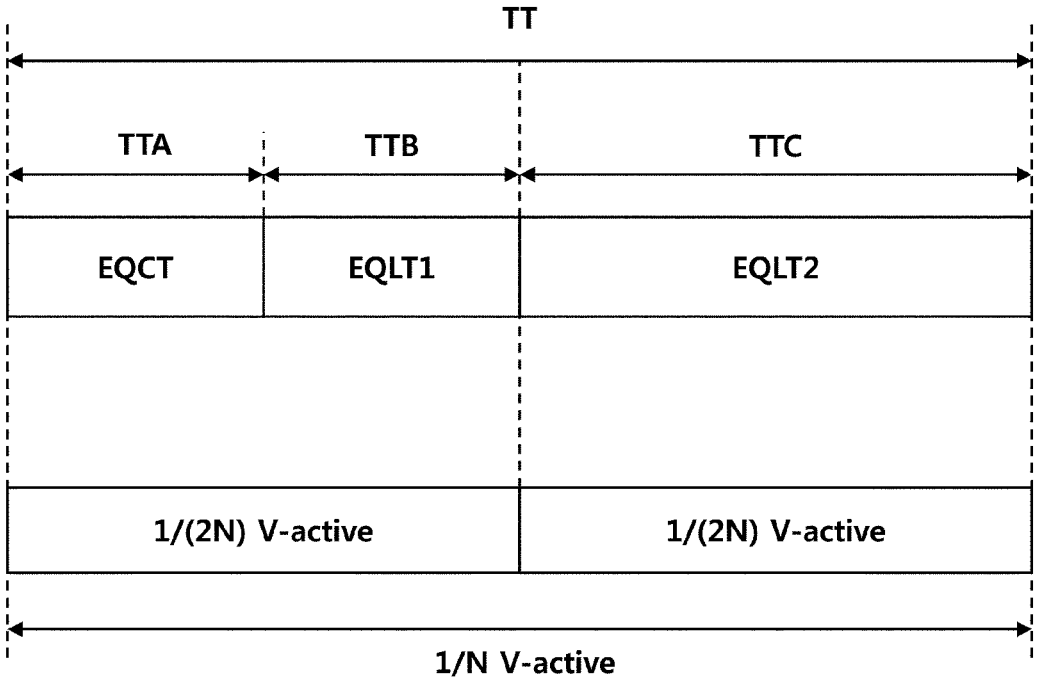
FIG. 18 is a diagram illustrating a comparison between a frame active time and a time of an EQ test signal according to a second example in an embodiment.

FIG. 18 is a diagram illustrating a comparison between a frame active time and a time of an EQ test signal according to a second example in an embodiment.

Referring to FIG. 18, the time TT at which the EQ test signal is transmitted may be equal to 1/N of the frame active time period (1/N V-active). In addition, a first time TTA at which the EQ clock pattern EQCT is transmitted and a second time TTB at which the first EQ link data EQLT1 is transmitted may be included in 1/(2N) of the frame active time period (1/(2N) V-active), and a third time (TTC) at which the second EQ link data EQLT2 is transmitted may be included in the remaining 1/(2N) of the frame active time period (1/(2N) V-active).

In addition, the plurality of EQ test signals according to such time configuration may be periodically transmitted in units of 1/N of the frame active time periods (1/N V-active). According to the first example, the configurations of the equalizer may be more accurately compared by putting all the EQ test signals in substantially the same environment, for example, an environment in which all the EQ test signals are transmitted in the frame active time period.

Meanwhile, a system according to an embodiment may include a configuration to restore communication back to a normal state when the communication fails.

Figure 19:
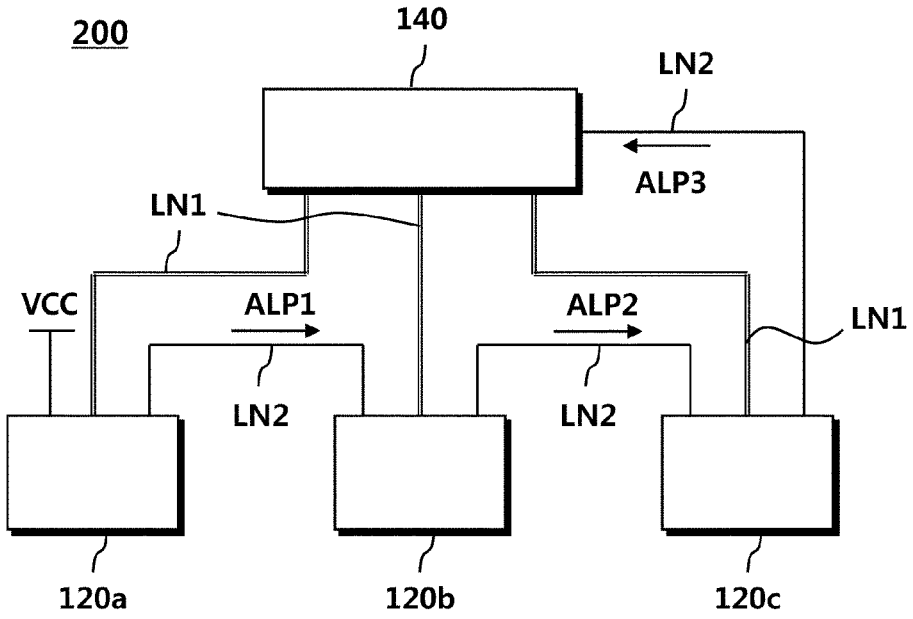
FIG. 19 is a schematic diagram illustrating a connection relationship of a system according to an embodiment.

FIG. 19 is a schematic diagram illustrating a connection relationship of a system according to an embodiment.

Referring to FIG. 19, in a system 200, the data processing device 140 and the plurality of data driving devices 120*a*, 120*b*, and 120*c* may be connected one-to-one through the first communication line LN1. In the system 200, the data processing device 140 and each of the data driving devices

120*a*, 120*b*, and 120*c* may be connected in a cascade manner through the second communication line LN2.

Figure 20:
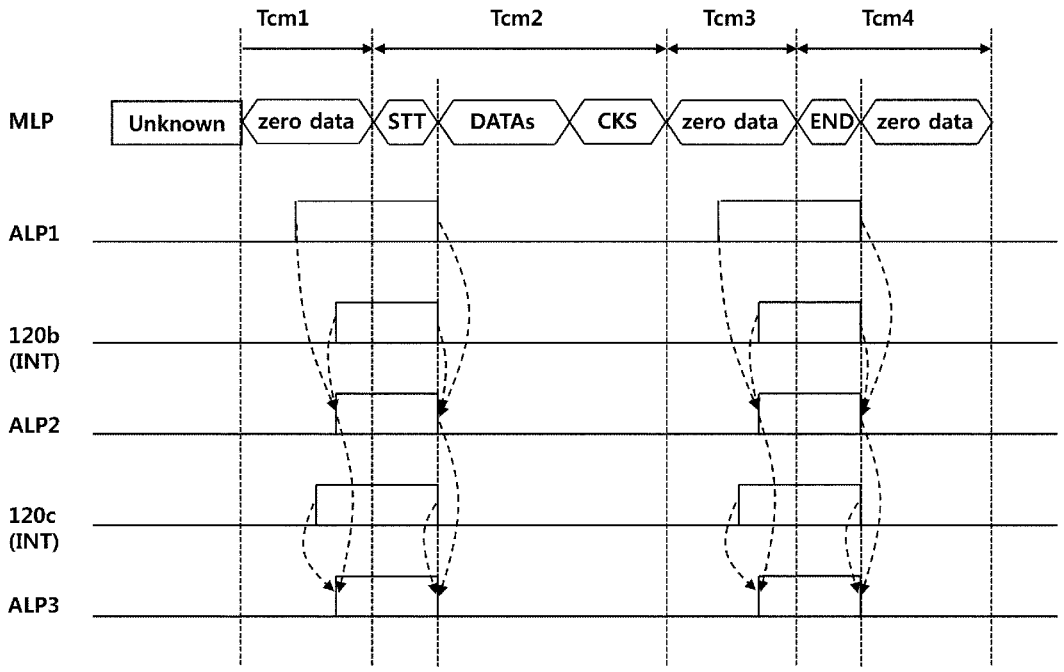
FIG. 20 is a diagram illustrating waveforms of communication signals when a data driving device normally receives a main communication signal in a system according to an embodiment.

FIG. 20 is a diagram illustrating waveforms of communication signals when a data driving device normally receives a main communication signal in a system according to an embodiment.

Referring to FIGS. 19 and 20, in this connection relationship, the first data driving device 120*a* may confirm a main communication signal received through the first communication line LN1 and may transmit a first auxiliary communication signal ALP1 as a feedback thereto to the second data driving device 120*b*. The second data driving device 120*b* may confirm the main communication signal received through the first communication line LN1, may generate a feedback thereto as an internal signal 120*b*(INT), and may generate a second auxiliary communication signal ALP2 by combining the internal signal 120*b*(INT) and the first auxiliary communication signal ALP1. The second data driving device 120*b* may transmit the second auxiliary communication signal ALP2 to the third data driving device 120*c*. The third data driving device 120*c* may confirm the main communication signal received through the first communication line LN1, may generate a feedback thereto as an internal signal 120*c*(INT), and may generate a third auxiliary communication signal ALP3 by combining the internal signal 120*c*(INT) and the second auxiliary communication signal ALP2. The third data driving device 120*c* may transmit the third auxiliary communication signal ALP3 to the data processing device 140 through the second communication line LN2.

Figure 21:
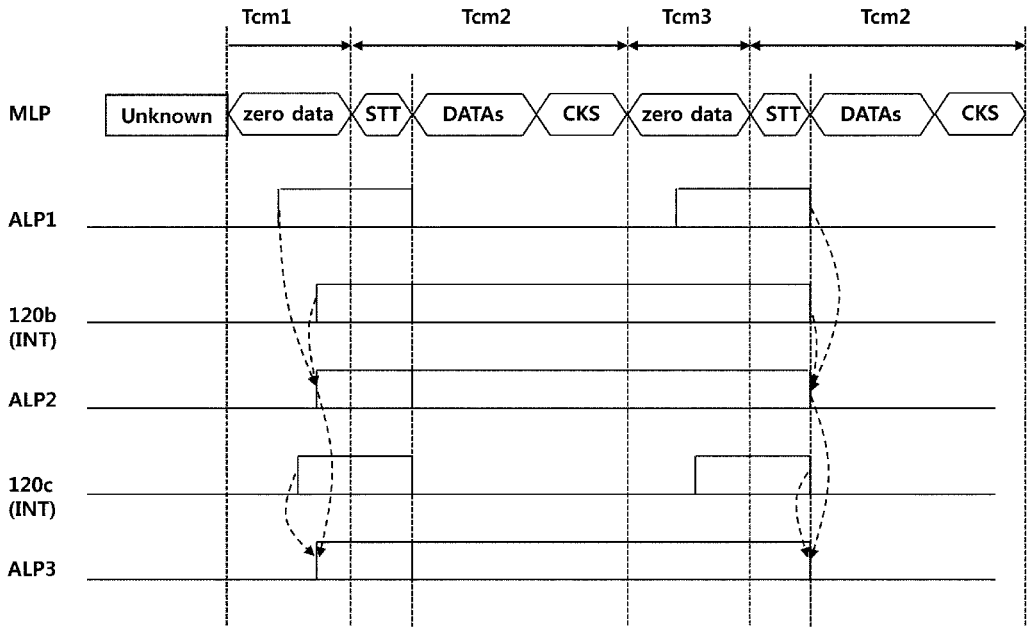
FIG. 21 is a diagram illustrating waveforms of communication signals when a data driving device does not normally recognize a start message in a system according to an embodiment.

FIG. 21 is a diagram illustrating waveforms of communication signals when a data driving device does not normally recognize a start message in a system according to an embodiment.

Referring to FIG. 21, the second data driving device 120*b* does not normally recognize a start message STT and thus cannot change the signal level of the second auxiliary communication signal ALP2. In this case, the auxiliary communication signal ALP3 of the last stage finally transmitted to the data processing device may not change the signal level.

In this case, when the auxiliary communication signal maintains the second signal level during a second time period Tcm2 or a third time period Tcm3, the data processing device may retransmit the data of the second time period Tcm2 subsequently to the third time period Tcm3. At this time, the data driving device may receive zero data due to the third time period Tcm3 and the start message STT due to the second time period Tcm2 again, so that communication can be restored to its normal state.

Figure 22:
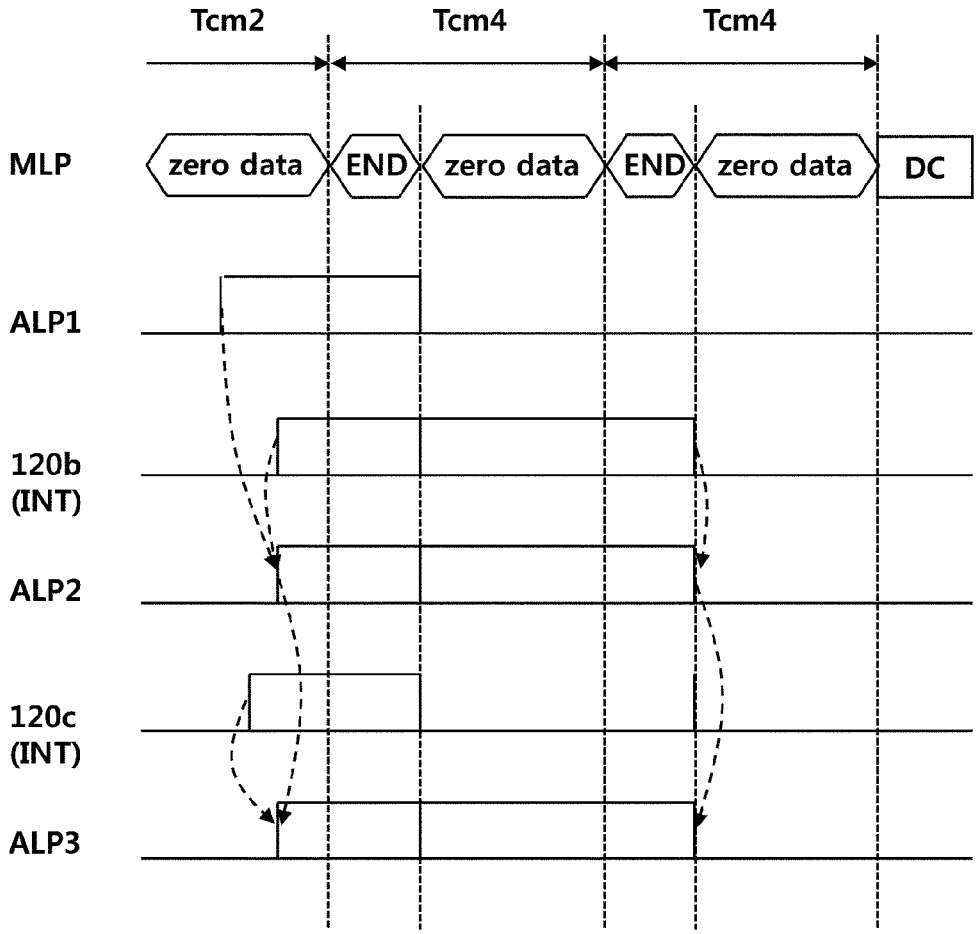
FIG. 22 is a diagram illustrating waveforms of communication signals when a data driving device does not normally recognize an end message in a system according to an embodiment.

FIG. 22 is a diagram illustrating waveforms of communication signals when a data driving device does not normally recognize an end message in a system according to an embodiment.

Referring to FIG. 22, the second data driving device 120*b* does not normally recognize an end message END and thus cannot change the signal level of the second auxiliary communication signal ALP2. In this case, the auxiliary communication signal ALP3 of the last stage finally transmitted to the data processing device may not change the signal level.

In this case, when the auxiliary communication signal maintains the second signal level during a fourth time period Tcm4 or during a zero data period of the fourth time period Tcm4, the data processing device may retransmit the signal of the fourth time period Tcm3. At this time, the data driving device may receive the zero data and the end message END due to the fourth time period Tcm4 again, so that the communication can be restored to the normal state.

Figure 23:
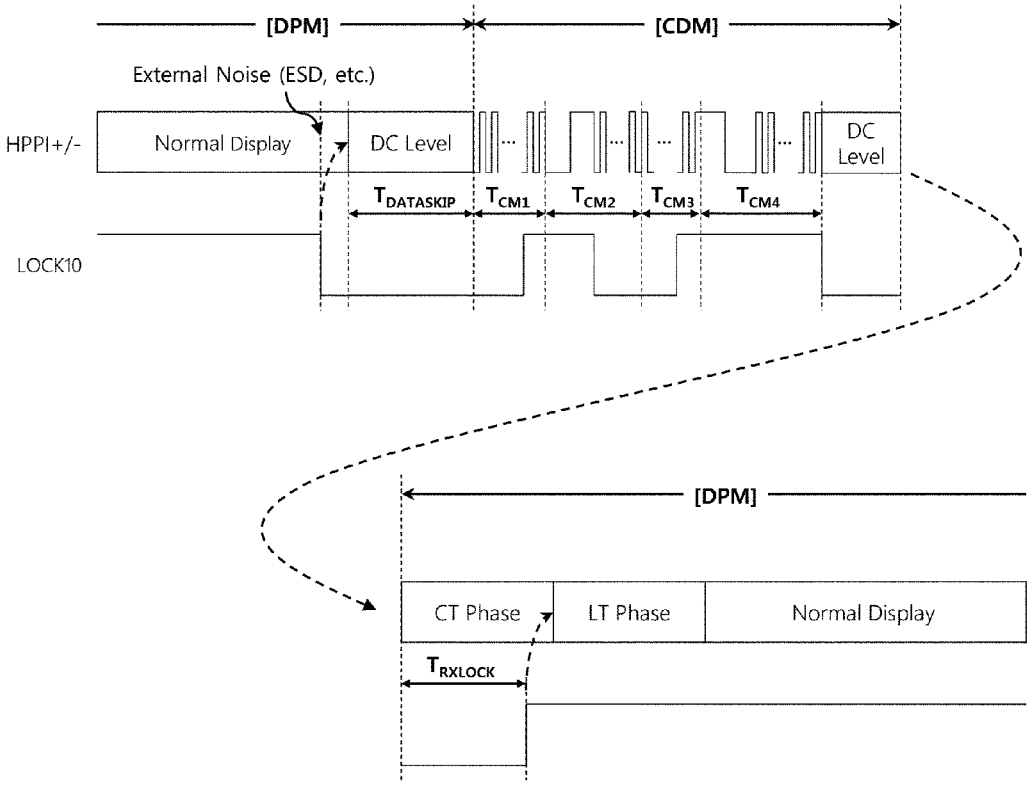
FIG. 23 is a diagram illustrating a sixth example of the sequence of a main communication signal and an auxiliary communication signal in a display device according to an embodiment.
Figure 24:
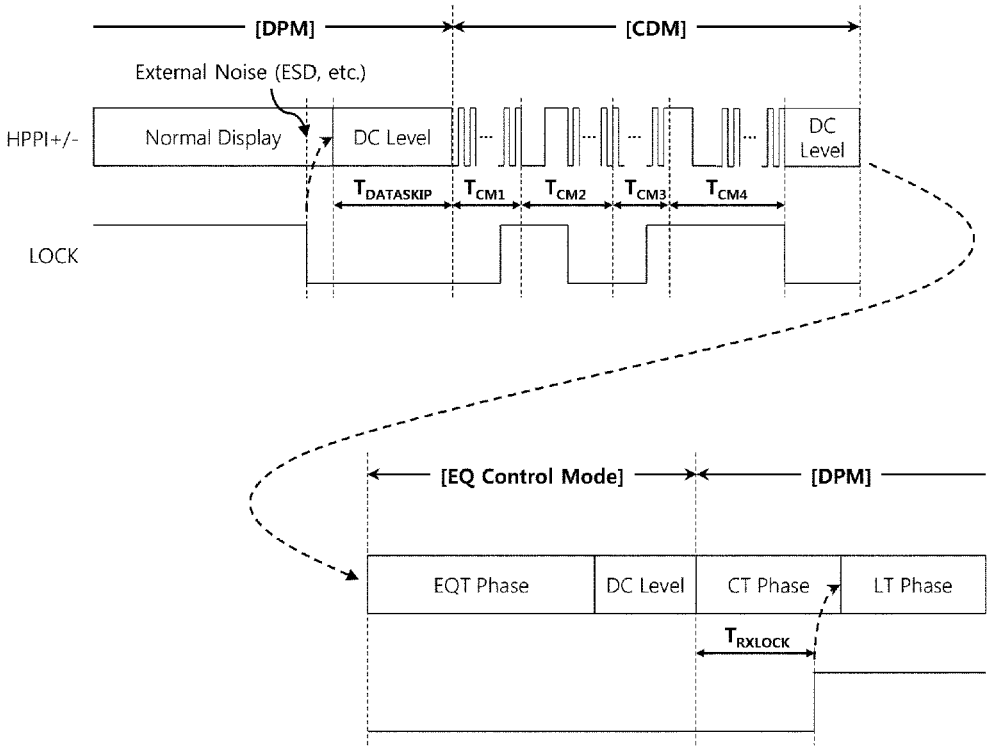
FIG. 24 is a diagram illustrating a seventh example of the sequence of a main communication signal and an auxiliary communication signal in a display device according to an embodiment.

FIG. 23 is a diagram illustrating a sixth example of the sequence of a main communication signal and an auxiliary communication signal in a display device according to an embodiment, and FIG. 24 is a diagram illustrating a seventh example of the sequence of a main communication signal and an auxiliary communication signal in a display device according to an embodiment.

When PLL is unlocked due to external influences, for example, noise, etc., in a display communication mode, or when a clock or a link is broken, the signal level of the auxiliary communication signal may be changed from the second signal level to the first signal level.

In this case, the data processing device may restore communication by re-executing a command communication mode or re-executing clock training and link training. According to an embodiment, the data processing device may re-execute the command communication mode and clock training/link training, or may re-execute only the clock training/link training. Alternatively, the data processing device may re-execute all the command communication mode, an equalizer test mode, and the clock training/link training.

For example, in a case in which the data processing device normally operates in a display communication mode for a specific time or more, when an unlock occurs, the data processing device may re-execute the display communication mode without passing through the command communication mode. Here, the specific time is not a problem of the main communication signal, but a time that can be considered that the unlock has occurred due to a momentary external factor, and may be, for example, several hundred-frame time. Such an operation method may be included in configuration data transmitted in the display communication mode and may be transmitted from the data processing device to the data driving device.

As another example, in a case in which the data processing device operates in the display communication mode for a specific time or more, when an unlock occurs, the data processing device may sequentially re-execute the command communication mode and the display communication mode. In this case, the data processing device may not re-execute the equalizer test mode. Here, the specific time is not a problem of the main communication signal operating at a high speed, but may be a time that can be considered that the unlock has occurred due to a momentary external factor, and may be several hundred-frame time. This operation method may be determined as a configuration value for an EQ test included in the data of the command communication mode. In this operation method, the data driving device needs to maintain the configuration value due to the EQ test, such as an EQ gain value.

Meanwhile, in a system in which the auxiliary communication signal is connected in a cascade manner, when an unlock occurs only in the data driving device connected to the data processing device, a difference in the operation state of the main communication signal may occur between the data driving device in an unlocked state and the data driving device in the normal state, thereby causing an unnecessary malfunction in the display device.

In order to prevent such a malfunction, the data processing device may configure a DC section in the main communication signal for a predetermined time Tdataskip when an unlock is recognized. Due to the DC section, the data driving devices in the normal state may not be able to train the clock, so that all the data driving devices have the same state in the unlocked state.

Meanwhile, the above description may be applied to a method in which a plurality of data driving devices receive data in a command communication mode at the same timing.

However, the present embodiment is not limited thereto, and each data driving device may receive data one by one in the command communication mode. In this manner, only the data driving device which has received the data in the command communication mode may generate and transmit an auxiliary communication signal, and the other data driving device may bypass the auxiliary communication signal. In addition, the data driving device having processed the command communication mode may change the main communication signal to a display communication mode. The data driving device changed into the display communication mode may combine the auxiliary communication signal received from the adjacent data driving device and the auxiliary communication signal generated by the data driving device by itself, thereby outputting the combined result to the second communication line. In order, the data driving device of one side may start to process the command communication mode, and the next data driving device may execute the command communication mode in a sequential manner according to the connection order of the second communication line. The data processing device may execute the command communication mode for the last data driving device connected to the second communication line and may then enter the display communication mode.

Meanwhile, in a case in which communication is restored in the unlocked state, when the data processing device enters the command communication mode, it is possible to select whether to execute the command communication mode with respect to a plurality of data driving devices at the same timing, or whether to execute the command communication mode one by one in a sequential manner with respect to each of the data driving devices. This selection may be determined such that the same sequence as an initial sequence restores communication in the unlocked state, and the determination value may be included in the configuration data transmitted in the display communication mode.

Figure 25:
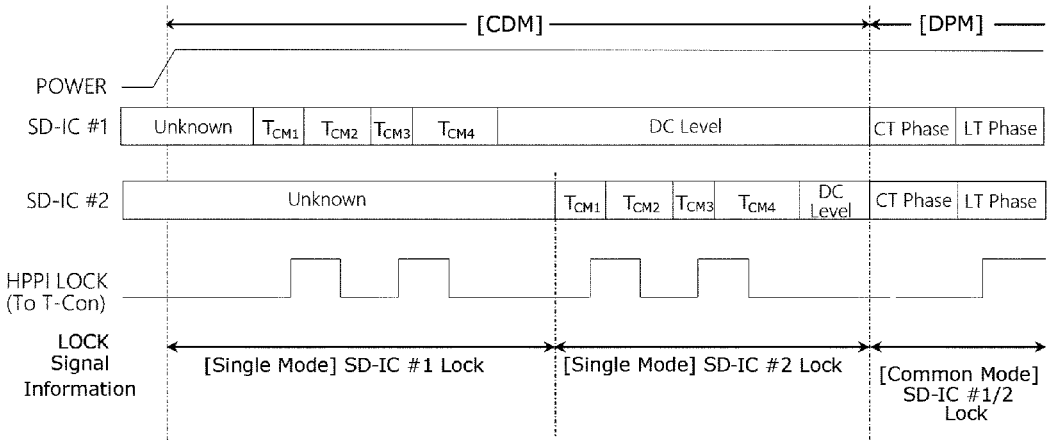
FIG. 25 is a diagram illustrating an example of a command communication mode that can be applied to an embodiment.
Figure 26:
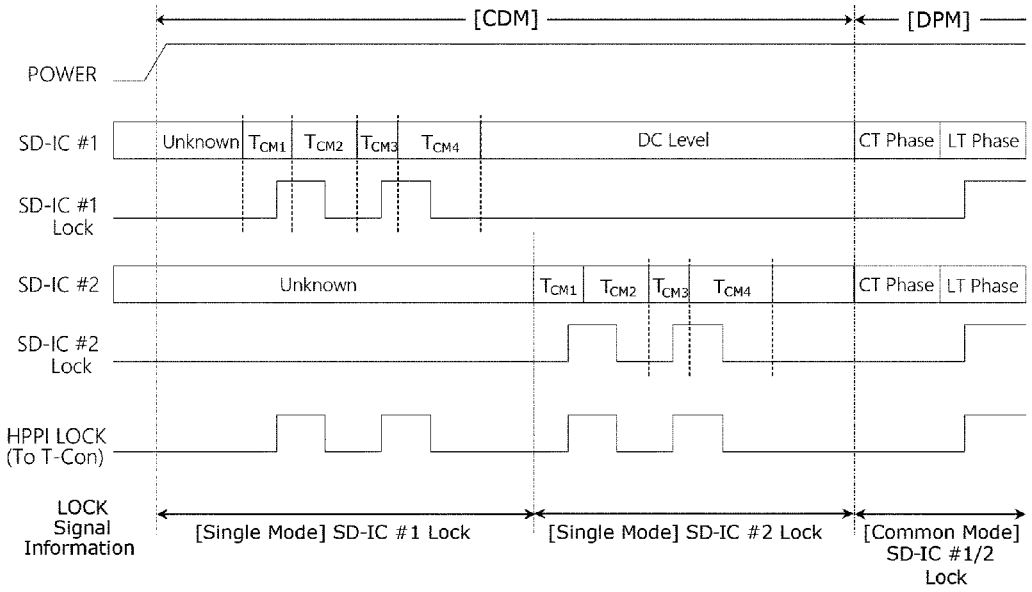
FIG. 26 is a diagram illustrating another example of a command communication mode that can be applied to an embodiment.

FIG. 25 is a diagram illustrating an example of a command communication mode that can be applied to an embodiment, and FIG. 26 is a diagram illustrating another example of a command communication mode that can be applied to an embodiment.

Referring to FIGS. 25 and 26, both a data processing device T-Con and a data driving device SD-IC operate in a command communication mode after power-on.

First, only a first data driving device SD-IC #1 may receive data (Command Data) of the command communication mode. Next, a second data driving device SD-IC #2 may control a LOCK line (second communication line) according to the received data. Next, when a CM-END pattern (END message) is received, a main-link (main communication signal) may be operated in a display communication mode and a LOCK line bypass operation may be stopped.

When command data configuration for all the SD-ICs is completed, TX (data processing device)-based main-link operates in the display communication mode.

What is claimed is:

1. A data processing device connected by communication lines with a data driving device configured to drive pixels using image data, comprising:

a first communication unit configured to transmit the image data to the data driving device through a first communication line at a first data rate; and a second communication unit configured to receive, as a feedback, a training state of a first clock for receiving the image data from the data driving device through a second communication line, wherein the first communication unit, before transmitting the image data, transmits a set value for transmitting and receiving the image data through the first communication line at a second data rate which is lower than the first data rate.

2. The data processing device of claim 1, wherein the first communication unit indicates, using the set value, a data rate of the image data, a use of a scramble, or a use of a limited run length code (LRLC).

3. The data processing device of claim 1, wherein the first communication unit further comprises a commander by which communication signals at the second data rate are generated and the second communication unit receives, as a feedback, a receiving state of the communication signals at the second data rate through the second communication line.

4. The data processing device of claim 1, wherein the first communication unit transmits the image data at the first data rate in a display communication mode and at the second data rate in a command communication mode, and a voltage of the first communication line is maintained as a predetermined DC voltage for a predetermined time between the command communication mode and the display communication mode.

5. The data processing device of claim 4, wherein the display communication mode includes a clock training time period and a link training time period and when a clock training is completed in the data driving device, a voltage of the second communication line is changed from a first level to a second level.

6. The data processing device of claim 1, wherein the first communication unit transmits the set value using a Manchester code in which two unit times constitute one bit and, if signals of different voltage levels are assigned to the two unit times constituting one bit, a corresponding bit represents zero.

7. The data processing device of claim 6, wherein the first communication unit transmits the set value using a communication protocol including a first time period and a second time period, and the first communication unit transmits zero data in the first time period and the set value in the second time period.

8. The data processing device of claim 7, wherein the data driving device trains a second clock for a communication at the second data rate using the zero data received in the first time period and transmits a training state of the second clock as a feedback through the second communication line.

9. The data processing device of claim 7, wherein the first communication unit transmits a start message in a first phase in the second time period, a data message including the set value in a second phase therein, and a checksum message including a checksum value in a third phase therein.

10. The data processing device of claim 1, wherein the first communication unit transmits a plurality of equalizer (EQ) test signals before transmitting the image data and the data driving device receives the plurality of EQ test signals using different equalizer set values, each applied to each EQ test signal in order to search for an equalizer set value with which the receiving rate of the EQ test signal is high.

11. A data driving device configured to convert image data into a data voltage and to drive a pixel using the data voltage, comprising:

a first communication unit configured to receive the image data through a first communication line from a data processing device at a first data rate; and a second communication unit configured to transmit, as a feedback, a training state of a first clock for receiving the image data to the data processing device through a second communication line, wherein the first communication unit receives a set value for transmitting and receiving the image data through the first communication line at a second data rate which is lower than the first data rate.

12. The data driving device of claim 11, further comprising at least one of a descrambler configured to restore received data in a scrambled state into data in an original state and a decoder configured to decode data according to a Limited Run Length Code (LRLC) method.

13. The data driving device of claim 12, wherein the first communication unit receives a value indicating, using the set value, a data rate of the image data, a use of a scramble, or a use of the LRLC method.

14. The data driving device of claim 11, wherein the first communication unit, before receiving the image data, receives a plurality of equalizer (EQ) test signals using different equalizer set values, each applied to each EQ test signal in order to search for an equalizer set value with which the receiving rate of an EQ test signal is high.

15. The data driving device of claim 14, wherein the EQ test signal consists of an EQ clock pattern and EQ link data, and the first communication unit trains the first clock using the EQ clock pattern and trains a link clock using the EQ link data.

16. The data driving device of claim 15, wherein the EQ link data consists of first EQ link data and second EQ link data, wherein the first EQ link data includes a pattern in which symbol sets each comprising a plurality of symbols are repeated and the second EQ link data consists of DC-balanced and scrambled zero symbols.

17. The data driving device of claim 15, wherein the EQ link data consists of first EQ link data and second EQ link data, wherein the first communication unit trains a link clock using the first EQ link data, the EQ clock pattern and the first EQ link data are received in a frame vertical blank time period in a frame time period, and the second EQ link data is received in a frame active time period therein.

18. A system comprising:

a plurality of data driving devices, each configured to convert image data into a data voltage and to drive a pixel using the data voltage; and a data processing device configured to transmit the image data to a data driving device through a first communication line at a first data rate, wherein the data processing device transmits, before transmitting the image data, a set value for transmitting and receiving the image data through the first communication line at a second data rate which is lower than the first data rate.

19. The system of claim 18, wherein each of the plurality of data driving devices transmits, as a feedback, a training state of a first clock for receiving the image data through a second communication line, wherein the second communication line is connected in a cascade form.

20. The system of claim 19, wherein each of the plurality of data driving devices transmits a feedback for communication, which is transmitted and received at the second data rate through the first communication line, to the data processing device through the second communication line.

* * * * *